US009950532B2

(12) United States Patent
Togashi et al.

(10) Patent No.: US 9,950,532 B2
(45) Date of Patent: Apr. 24, 2018

(54) LIQUID EJECTING HEAD AND MANUFACTURING METHOD THEREOF

(71) Applicant: SEIKO EPSON CORPORATION, Tokyo (JP)

(72) Inventors: Isamu Togashi, Matsumoto (JP); Shuji Sugawara, Sakata (JP); Yoichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/976,104

(22) Filed: Dec. 21, 2015

(65) Prior Publication Data

US 2016/0193835 A1 Jul. 7, 2016

(30) Foreign Application Priority Data

Jan. 5, 2015 (JP) ..... 2015-000451

(51) Int. Cl.
*B41J 2/16* (2006.01)
*B41J 2/14* (2006.01)

(52) U.S. Cl.
CPC ..... *B41J 2/1632* (2013.01); *B41J 2/14233* (2013.01); *B41J 2/161* (2013.01); *B41J 2/1623* (2013.01); *B41J 2/1637* (2013.01); *B41J 2002/14362* (2013.01); *B41J 2002/14419* (2013.01); *B41J 2202/20* (2013.01)

(58) Field of Classification Search
CPC ..... B41J 2/1632; B41J 2/161; B41J 2/162
See application file for complete search history.

(56) References Cited

U.S. PATENT DOCUMENTS 6,193,360 B1 * 2/2001 Nishiwaki ..... B41J 2/055 347/70
2006/0268063 A1 * 11/2006 Inaoka ..... B29C 65/7841 347/54

FOREIGN PATENT DOCUMENTS

JP 2009-160786 A 7/2009
JP 2009-208404 A 9/2009
JP 2009-214284 A 9/2009

* cited by examiner

*Primary Examiner* — Sharon A Polk
(74) *Attorney, Agent, or Firm* — Foley & Lardner LLP

(57) ABSTRACT

A manufacturing method of a liquid ejecting head includes providing a stepped region that is formed by half-blanking and has a height different from a plane surface region, and a protrusion that is formed by drawing within the stepped region and protrudes on a liquid ejection side in the plane surface region of a fixing plate defining a liquid ejection surface in which nozzles ejecting liquid are provided; and fixing the liquid ejection section having a flow path member in which a flow path supplying the liquid is provided on a side opposite to a side in which the protrusion protrudes to the flat plate.

15 Claims, 23 Drawing Sheets

LIQUID EJECTING HEAD AND MANUFACTURING METHOD THEREOF

CROSS REFERENCES TO RELATED APPLICATIONS

This application claims priority to Japanese Patent Application No. 2015-000451 filed on Jan. 5, 2015. The entire disclosures of Japanese Patent Application No. 2015-000451 is hereby incorporated herein by reference.

BACKGROUND

1. Technical Field

The present invention relates to a technique for ejecting liquid such as ink.

2. Related Art

When manufacturing an ejecting head ejecting liquid, there is a case where a hole is bored or a protrusion is provided by press processing in a metal flat plate (plate). For example, in a head of a printer disclosed in JP-A-2009-160786, a hole of an inlet port for introducing ink is formed in a plate-shaped cavity section. When forming such a hole by press processing, a dies is provided on one surface of a thin metal flat plate, a punch is pressed from the other surface, and the hole is formed by punching.

However, when pressing the punch on the flat plate, distortion or undulation (warpage) is generated on the surface of the flat plate due to generation of material flow in a periphery of the flat plate by pulling by the punch. This phenomenon remarkably appears as a thickness of the flat plate becomes thinner and there is a problem that a flatness of the flat plate is likely to be lowered.

SUMMARY

An advantage of some aspects of the invention is to secure a flatness of a flat plate even if press processing is performed in the flat plate.

Aspect 1

According to a preferable aspect (aspect 1) of the invention, there is provided a manufacturing method of a liquid ejecting head including providing a stepped region that is formed by half-blanking and has a height different from a plane surface region, and a protrusion that is formed by drawing within the stepped region and protrudes on a liquid ejection side in the plane surface region of a flat plate defining a liquid ejection surface in which nozzles ejecting liquid are provided; and fixing a flow path member in which a flow path supplying the liquid is provided on a side opposite to a side in which the protrusion protrudes to the flat plate. In the aspect 1, the protrusion is formed so as to protrude on a liquid ejection side within the stepped region of which the height is different from that of the plane surface region in the flat plate defining the liquid ejection surface (for example, it may be a fixing plate, if there is a fixing plate that fixes the nozzle plate in which the liquid ejection nozzles are formed, or a nozzle plate if there is no fixing plate). Thus, since distortion due to drawing (press processing) is suppressed or corrected, it is possible to ensure a flatness of the flat plate after press processing. Furthermore, in the aspect 1, it is possible to further reliably fix the flow path member by fixing the flow path member to the flat plate of which the flatness is ensured after drawing compared to a case where the stepped region is not provided. Furthermore, in the aspect 1, since the protrusion protruding on the liquid ejection side is provided in the flat plate defining the liquid ejection surface, even if a medium approaches the liquid ejection surface by being deformed (for example, curled), the protrusion becomes hindrance and the medium does not reach the liquid ejection surface. Thus, it is possible to effectively prevent the medium from coming into contact with the liquid ejection surface. Moreover, the flow path member may be directly fixed to the flat plate or may be fixed to the flat plate through another member.

Aspect 2

In a preferable example (aspect 2) according to the aspect 1, the stepped region may be formed so as to protrude on the liquid ejection side. In the aspect 2, since the stepped region is formed so as to protrude on the liquid ejection side (protruding side of the protrusion), a height of the protrusion from the liquid ejection surface becomes a height that is provided by adding a protrusion amount of the stepped region to a protrusion amount of the protrusion. Thus, it is possible to effectively increase the height of the protrusion from the liquid ejection surface compared to a configuration in which the stepped region protrudes on a side opposite to the liquid ejection side (protruding side of the protrusion).

Aspect 3

In a preferable example (aspect 3) according to the aspect 1 or 2, a side surface of the stepped region may be a shear surface formed by the half-blanking. In the aspect 3, since the side surface of the stepped region is the shear surface and a fracture surface does not occur, it is possible to sufficiently maintain strength of the flat plate.

Aspect 4

In a preferable example (aspect 4) according to any one of the aspects 1 to 3, in the providing the protrusion within the stepped region, the protrusion may be formed by drawing after the stepped region is formed by the half-blanking. In the aspect 4, since the protrusion is formed by drawing after the stepped region is formed by half-blanking, it is possible to suppress material flow within the stepped region that is sheared by half-blanking even if the material flow is generated by drawing. Thus, it is possible to suppress the material flow around the stepped region. As described above, it is possible to ensure the flatness of the flat plate by suppressing distortion due to drawing (press processing). Furthermore, since formation of the stepped region becomes bead processing, it is possible to suppress warpage of the flat plate by an effect of bead processing and to improve durability (strength) of the flat plate. Moreover, the flatness of the flat plate is likely to be maintained even if the stepped region has multiple steps by performing half-blanking in a plurality of times.

Aspect 5

In a preferable example (aspect 5) according to any one of the aspects 1 to 3, in the providing the protrusion within the stepped region, the stepped region may be formed by the half-blanking after the protrusion is formed by the drawing. In the aspect 5, since the stepped region is formed by half-blanking after the protrusion is formed by drawing, even if distortion occurs by material flow generated in a periphery of the stepped region by drawing that is performed earlier, the stepped region is formed by half-blanking thereafter becomes bead processing. Thus, it is possible to correct distortion generated by drawing (press processing) by an effect of bead processing. Thus, it is possible to ensure the flatness of the flat plate.

Aspect 6

In a preferable example (aspect 6) according to any one of the aspects 1 to 5, a protrusion amount of the protrusion from the stepped region may be greater than a stepped amount of the stepped region from the plane surface region. In the aspect 6, since the protrusion amount of the protrusion from the stepped region is greater than the stepped amount of the stepped region from the plane surface region, it is possible to allow the protrusion to protrude more than the stepped region. Thus, it is possible to effectively prevent the medium from coming into contact with the liquid ejection surface.

Aspect 7

In a preferable example (aspect 7) according to any one of the aspects 1 to 6, the protrusion amount of the protrusion may be greater than a thickness of the stepped region of the flat plate. In the aspect 7, since a height of the protrusion is ensured to an extent that the protrusion amount of the protrusion is greater than the thickness of the stepped region of the flat plate, it is possible to effectively prevent the medium from coming into contact with the liquid ejection surface.

Aspect 8

In a preferable example (aspect 8) according to any one of the aspects 1 to 7, the flat plate may have a through-hole within the plane surface region, and the through-hole may be formed after the protrusion is formed. In the aspect 8, the through-hole (including, for example, an opening section for attaching the nozzle plate if the protrusion is formed in the fixing plate, a nozzle opening if the protrusion is formed in the nozzle plate, and the like) is formed after the protrusion is formed by drawing. Thus, it is possible that the through-hole is not affected by influence of distortion by drawing. Thus, It is possible to form the through-hole in the plane surface region with further high precision.

Aspect 9

In a preferable example (aspect 9) according to the aspect 8, the flat plate may have a thick region and a thin region of which thicknesses are different from each other within the plane surface region, the through-hole may be provided within the thin region, and a liquid ejection section having a nozzle plate in which liquid ejection nozzles are formed may be fixed to the flat plate such that the nozzle plate exposes on the liquid ejection side within the through-hole. In the aspect 9, the flat plate has the thick region and the thin region of which the thicknesses are different from each other within the plane surface region, and the through-hole in which the nozzle plate exposures on the liquid ejection side is provided within the thin region. Thus, it is possible to improve durability (strength) of the flat plate by the thick region. Therefore, distortion due to press processing is suppressed and it is possible to easily maintain the flatness of the flat plate. Furthermore, in the aspect 9, the through-hole in which the nozzle plate exposures on the liquid ejection side is provided within the thin region. Thus, it is possible to allow a distance between the nozzle plate and the medium to be close.

Aspect 10

According to a preferable aspect (aspect 10) of the invention, there is provided a manufacturing method of a liquid ejecting head including forming a thick region and a thin region of which thicknesses are different from each other, and a through-hole provided within the thin region in a plane surface region of a flat plate defining a liquid ejection surface in which nozzles ejecting liquid are provided; and fixing a liquid ejection section having a nozzle plate in which liquid ejection nozzles are formed to the flat plate such that the nozzle plate exposes on a liquid ejection side within the through-hole. In the aspect 10, the thick region and the thin region of which thicknesses are different from each other, and the through-hole provided within the thin region are formed. Thus, it is possible to improve strength of the flat plate by the thick region. Therefore, distortion due to press processing is suppressed and it is possible to easily maintain the flatness of the flat plate. Furthermore, in the aspect 10, the liquid ejection section having the nozzle plate in which the liquid ejection nozzles are formed is fixed to the flat plate such that the nozzle plate exposures on the liquid ejection side within the through-hole. Thus, it is possible to allow a distance between the nozzle plate and the medium to be close. Furthermore, in the aspect 10, it is possible to further reliably fix the liquid ejection section by fixing the liquid ejection section to the flat plate of which the flatness is ensured after press processing for forming the through-hole within the thin region.

Aspect 11

In a preferable example (aspect 11) according to the aspect 9 or 10, the thin region may be formed such that a surface of the flat plate on a side opposite to the liquid ejection side is recessed and the liquid ejection section may be fixed within the recessed region. In the aspect 11, the thin region is formed such that the surface of the flat plate on the side opposite to the liquid ejection side is recessed and the liquid ejection section is fixed within the recessed region. Thus, it is possible to fix the liquid ejection section on the liquid ejection side by a recessed amount within the thin region compared to a case where the liquid ejection section is fixed without forming the thin region. Thus, an interval between the nozzle plate and the medium can be narrowed. Thus, it is possible to increase prevention effect of a position shift of ejected liquid.

Aspect 12

In a preferable example (aspect 12) according to the aspect 9 or 10, the thin region may be formed such that a surface of the flat plate on the liquid ejection side is recessed and the liquid ejection section may be fixed to a surface on a side opposite to the recessed region. In the aspect 12, the thin region is formed such that the surface of the flat plate on the liquid ejection side is recessed and the liquid ejection section is fixed to the surface on the side opposite to the recessed region. Thus, it is possible to increase the distance between the nozzle plate and the medium by a recessed amount within the thin region. Therefore, even if the medium is deformed (curled, for example), the medium is unlikely to come into contact with the nozzle plate compared to the case of the aspect 11.

Aspect 13

In a preferable example (aspect 13) according to any one of the aspects 1 to 12, the manufacturing method may further include performing bending the plane surface region of the flat plate, and fixing a side surface of a flow path member forming a flow path of liquid to a portion in which bending of the flat plate is performed. In the aspect 13, performing bending the flat plate is provided. Thus, it is possible to perform bending in the plane surface region after forming of the protrusion is performed within the stepped region or the through-hole within the thin region by press processing. Therefore, it is possible to perform bending without receiving influence of press processing. Thus, it is possible to perform bending with high precision. Furthermore, in the aspect 13, fixing the side surface of the support body forming the flow path of the liquid in the portion in which bending of the flat plate is provided. Thus, as described above, it is possible to fix the side surface of the support body in the portion in which bending is performed with high precision. Thus, it is possible to fix the side surface of the support body with further high precision.

Aspect 14

According to a preferable aspect (aspect 14) of the invention, there is provided a liquid ejecting head including a flat plate that defines a liquid ejection surface in which nozzles ejecting liquid are provided; and a protrusion that is provided within a stepped region of which a height is different from that of a plane surface region of the flat plate so as to protrude on a liquid ejection side. In the aspect 14, the protrusion is formed so as to protrude on the liquid ejection side within the stepped region of which the height is different from that of the plane surface region in the flat plate defining the liquid ejection surface. Thus, since distortion due to press processing for forming the protrusion is suppressed or corrected, it is possible to ensure the flatness of the flat plate after press processing.

Aspect 15

According to a preferable aspect (aspect 15) of the invention, there is provided a liquid ejecting head including a liquid ejection section that has a nozzle plate in which nozzles ejecting liquid are provided; and a flat plate that fixes a plurality of liquid ejection sections. The flat plate has a thick region and a thin region of which thicknesses are different from each other, and a through-hole that is provided within the thin region, and the nozzle plate exposes on a liquid ejection side within the through-hole. In the aspect 15, the thick region and the thin region of which thicknesses are different from each other, and the through-hole provided within the thin region are formed. Thus, it is possible to improve the strength of the flat plate by the thick region. Therefore, distortion due to press processing is suppressed and it is possible to easily maintain the flatness of the flat plate. A preferable example of a liquid ejecting apparatus is a printing apparatus ejecting ink onto the medium such as a printing sheet, but usage of the liquid ejecting apparatus according to the invention is not limited to printing.

BRIEF DESCRIPTION OF THE DRAWINGS

The invention will be described with reference to the accompanying drawings, wherein like numbers reference like elements.

FIG. 7A is a sectional view that is taken along line VIIA-VIIA of the fixing plate illustrated in FIG. 6, and FIG. 7B is a sectional view illustrating a case where the liquid ejection section is fixed to the fixing plate.

FIG. 16A is a sectional view that is taken along line XVIA-XVIA of the fixing plate illustrated in FIG. 6, and FIG. 16B is a sectional view illustrating a case where the liquid ejection section is fixed to the fixing plate.

FIG. 17A is a sectional view that is taken along line XVIIA-XVIIA of the fixing plate illustrated in FIG. 6, and FIG. 17B is a sectional view illustrating a case where the liquid ejection section is fixed to the fixing plate.

DESCRIPTION OF EXEMPLARY EMBODIMENTS

First Embodiment

Figure 1:
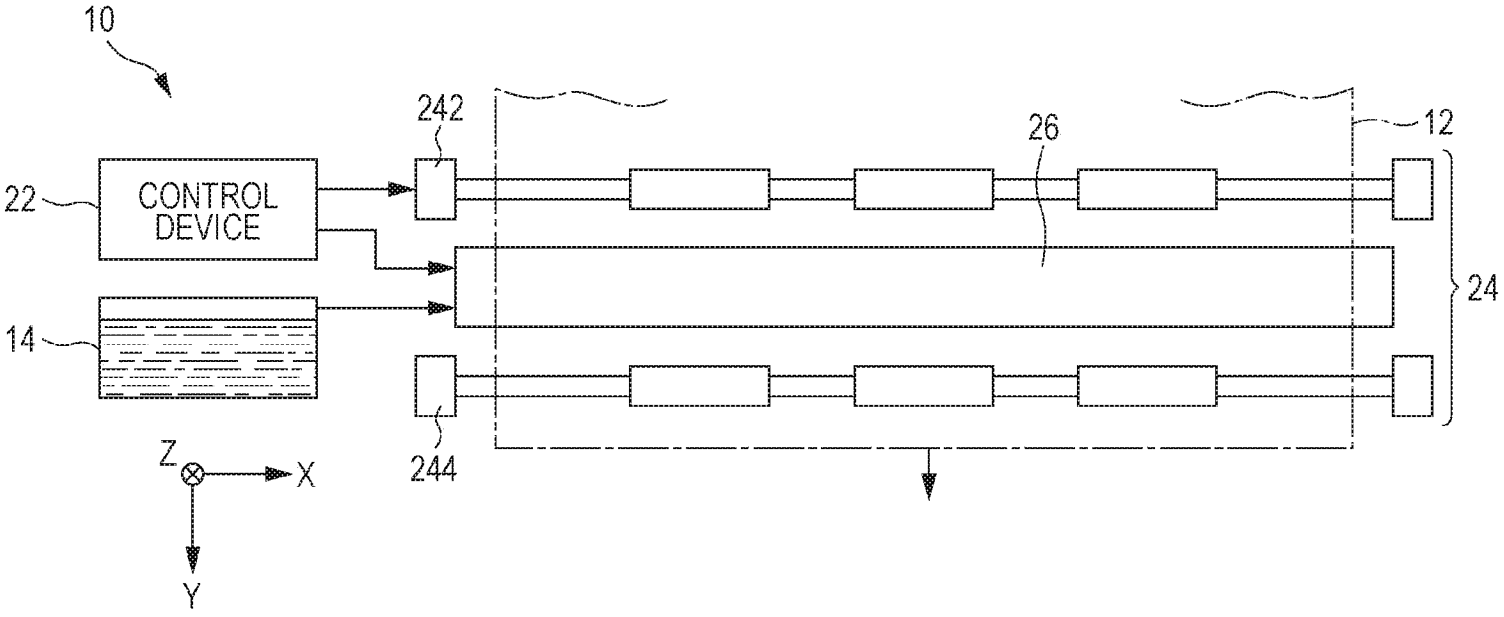
FIG. 1 is a configuration view of a printing apparatus to which a liquid ejecting head according to a first embodiment of the invention can be applied.

First, a liquid ejecting apparatus according to a first embodiment of the invention will be described by taking an ink jet type printing apparatus as an example. FIG. 1 is a partial configuration view of an ink jet type printing apparatus 10 according to the first embodiment of the invention. The printing apparatus 10 of the first embodiment is a liquid ejecting apparatus ejecting ink that is an example of a liquid onto a medium (ejection target) 12 such as a printing sheet and includes a control device 22, a transport mechanism 24, and a liquid ejecting unit 26. A liquid container (cartridge) 14 for storing the ink is mounted on the printing apparatus 10.

Figure 2:
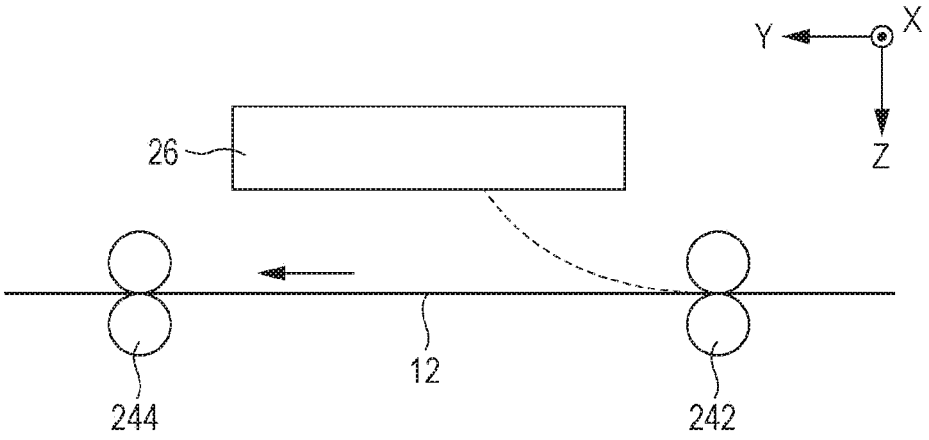
FIG. 2 is an explanatory view of an operation of the printing apparatus illustrated in FIG. 1 and is a view obtained by focusing on transport of a medium.

The control device 22 collectively controls each element of the printing apparatus 10. The transport mechanism 24 transports the medium 12 in a Y-direction under the control of the control device 22. FIG. 2 is a configuration view of the printing apparatus 10 that focuses on the transport of the medium 12. As illustrated in FIGS. 1 and 2, the transport mechanism 24 includes first rollers 242 and second rollers 244. The first rollers 242 are disposed on a negative side (upstream side in a transport direction of the medium 12) in the Y-direction when viewed from the second rollers 244 and transports the medium 12 on the second rollers 244 side. The second rollers 244 transports the medium 12 supplied from the first rollers 242 on a positive side in the Y-direction. However, a structure of the transport mechanism 24 is not limited to the example described above.

As illustrated by a broken line in FIG. 2, the medium 12 may be deformed (for example, curled) on the liquid ejecting unit 26 side between the first rollers 242 and the second rollers 244. For example, if it is assumed that the ink is ejected onto both sides (two-sided printing) of the medium 12 by sequentially reversing the medium 12, the deformation of the medium 12 becomes particularly apparent in a state where the ink is ejected onto only one surface. If the ink is sufficiently dried in a state where one surface is printed, the deformation of the medium 12 may be suppressed, but, for example, when performing printing at high speed in which a plurality of medium 12 are printed in a short time period, it is actually difficult to ensure a sufficient drying time and it is necessary to transport the medium 12 in a state of being deformed on the liquid ejecting unit 26 side by the transport mechanism 24.

Figure 3:
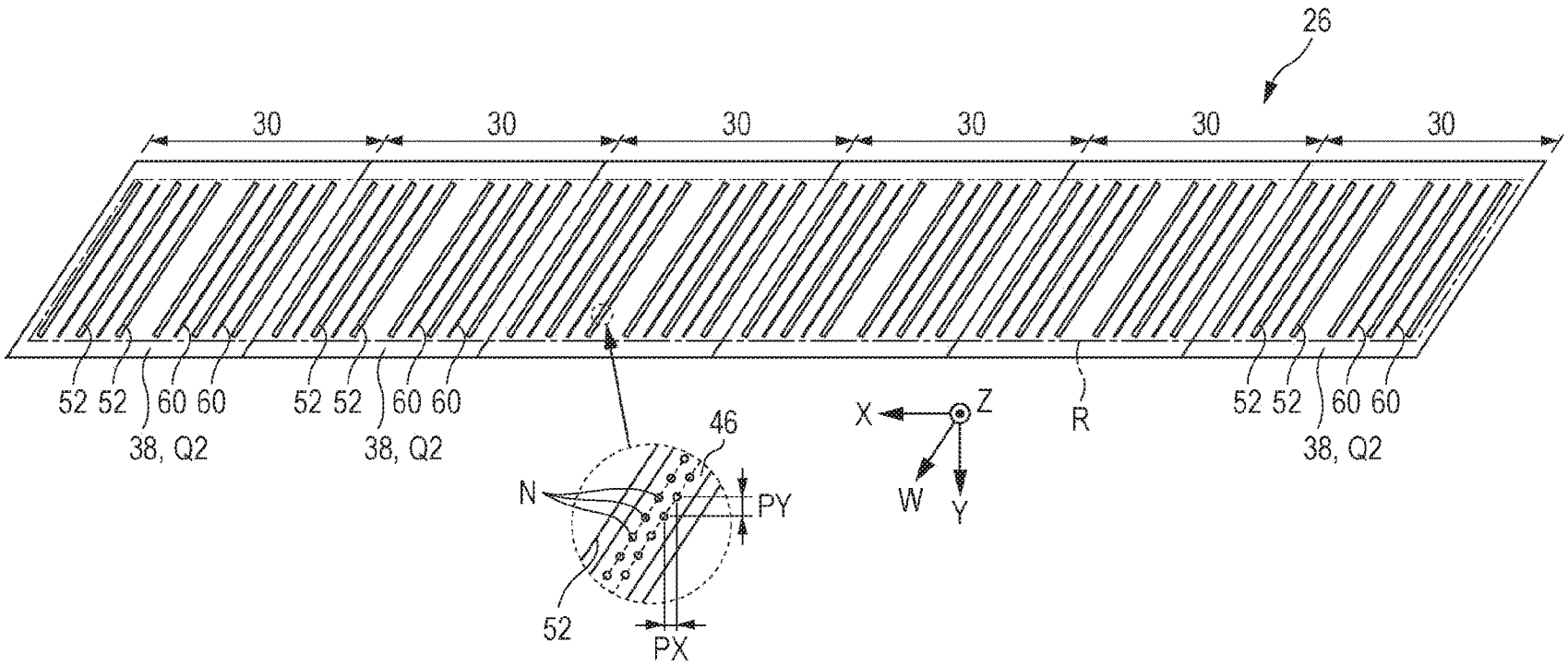
FIG. 3 is a plan view illustrating a configuration of a surface facing the medium in a liquid ejecting unit including a plurality of liquid ejecting heads.

The liquid ejecting unit 26 of FIG. 1 ejects the ink supplied from the liquid container 14 onto the medium 12 under the control of the control device 22. The liquid ejecting unit 26 of the first embodiment is a line head elongated in an X-direction (first direction) orthogonal to the Y-direction. FIG. 3 is a plan view of a liquid ejection surface (nozzle surface) that is a surface facing the medium 12 in the liquid ejecting unit 26. As illustrated in FIG. 3, a plurality of nozzles (ejecting holes) N are provided in the liquid ejection surface of the liquid ejecting unit 26. The liquid ejecting unit 26 is disposed such that the liquid ejection surface faces the medium 12 at predetermined intervals in a state where the liquid ejection surface is parallel to an X-Y plane. The liquid ejecting unit 26 ejects the ink onto the medium 12 in parallel to the transport of the medium 12 by the transport mechanism 24 and thereby a desired image is formed on a surface of the medium 12. Moreover, hereinafter, a direction perpendicular to the X-Y plane (for example, a plane parallel to the surface of the medium 12 having no deformation) is referred to as a Z-direction. An ejecting direction (for example, downward in the vertical direction) of the ink by the liquid ejecting unit 26 corresponds to the Z-direction. Furthermore, a lateral direction of a region (hereinafter, referred to as "nozzle distribution region") R in which the plurality of nozzles N are distributed in the liquid ejection surface of the liquid ejecting unit 26 corresponds to the Y-direction. A longitudinal direction of the nozzle distribution region R corresponds to the X-direction. As illustrated by the broken line in FIG. 2, in a situation in which the deformed medium 12 is transported, the medium 12 may come into contact with the liquid ejection surface of the liquid ejecting unit 26. In this case, when the ink remains in the liquid ejection surface, there is a possibility that the ink adheres to the medium 12. Thus, in the embodiment, the medium 12 does not come into contact with the liquid ejection surface by forming a protrusion section protruding from the liquid ejection surface and thereby it is possible to prevent the ink from adhering to the medium 12.

The liquid ejecting unit 26 of the first embodiment including the liquid ejecting head in which such a protrusion section is formed will be described. FIG. 3 is a view describing a configuration example of the liquid ejecting unit 26 of the first embodiment and a plan view illustrating a surface facing the medium 12. As illustrated in FIG. 3, the liquid ejecting unit 26 of the first embodiment includes a plurality (six in the first embodiment) of liquid ejecting heads 30. The plurality of liquid ejecting heads 30 are fixed to a housing (not illustrated) of the liquid ejecting unit 26 in a state of being arranged in the X-direction.

Each liquid ejecting head 30 is a flat plate defining the liquid ejection surface and includes a fixing plate 38 that exposes and fixes a nozzle plate 46 forming the plurality of nozzles N. Protrusion sections 60 are formed in the fixing plate 38 so as to protrude on a positive side in the Z-direction in FIG. 3, that is, a side (hereinafter, described as "liquid ejection side") in which liquid is ejected from the plurality of nozzles N. Specifically, a plurality of opening sections 52 in which the nozzle plates 46 are exposed and disposed are formed in the fixing plate 38 and the protrusion section 60 is formed between the opening sections 52.

In such a liquid ejecting unit 26, if the ink is supplied from the liquid container 14 to each liquid ejecting head 30, the ink is ejected from the plurality of nozzles N and as illustrated in FIG. 2, the ink adheres to the medium 12 that is transported by facing the liquid ejecting unit 26. In this case, even though the medium 12 is curled and then the medium 12 closes to the fixing plate 38 of the liquid ejecting head 30, since the protrusion sections 60 protrudes from the fixing plate 38 on the liquid ejection side, the medium 12 cannot come into contact with the nozzle plate 46 exposing from the opening section 52. Thus, it is possible to effectively prevent the ink from adhering to the medium 12.

Figure 4:
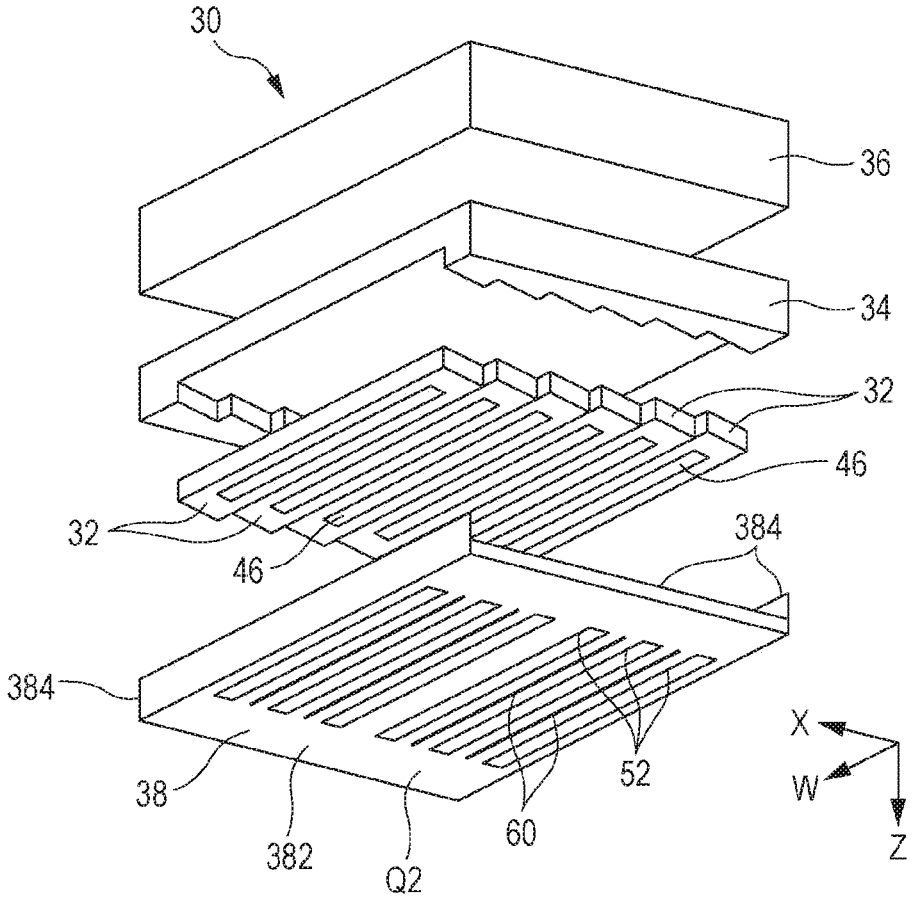
FIG. 4 is an exploded perspective view illustrating one configuration example of the liquid ejecting head of the liquid ejecting unit illustrated in FIG. 3.

Next, a configuration example of the liquid ejecting head 30 illustrated in FIG. 3 will be described in detail with reference to FIG. 4. FIG. 4 is an exploded perspective view illustrating the configuration example of the liquid ejecting head 30. Moreover, since all the plurality of liquid ejecting heads 30 illustrated in FIG. 3 have the same configuration, one of the liquid ejecting heads 30 will be described here. As illustrated in FIG. 4, the liquid ejecting head 30 of the first embodiment includes a plurality (six in the first embodiment) of liquid ejection sections 32, a support body 34, a flow path structure 36, and the fixing plate 38. The support body 34 is a housing accommodating and supporting the plurality of liquid ejection sections 32 and, for example, is formed by injection molding of a resin material or die-casting molding of a metal material. Furthermore, the support body 34 forms a flow path of the ink supplied to the plurality of liquid ejection sections 32. The flow path structure 36 is a structure in which the flow path for distributing the ink supplied from the liquid container 14 to the plurality of liquid ejection sections 32 and, for example, includes a valve structure for controlling opening and closing, or a pressure of the flow path and a filter for collecting air bubbles or foreign matters mixed in the ink within the flow path. Moreover, it is possible to integrally form the support body 34 and the flow path structure 36.

Each liquid ejection section 32 is configured as a head chip ejecting the ink from the plurality of nozzles N. As illustrated in FIG. 3, the plurality of nozzles N of each liquid ejection section 32 are arranged in two rows along a W-direction intersecting the X-direction. As illustrated in FIG. 3, the W-direction of the first embodiment is a direction inclined at a predetermined angle (for example, an angle within a range of 30° or more and 60° or less) with respect to the X-direction and the Y-direction within the X-Y plane. In the first embodiment, as illustrated in FIG. 3, positions of the plurality of nozzles N are selected such that a pitch (specifically, a distance between centers of the nozzles N) PX in the X-direction is narrower than a pitch PY in the Y-direction (PX<PY). As illustrated above, in the first embodiment, since the plurality of nozzles N are arranged in the W-direction inclined with respect to the Y-direction in which the medium 12 is transported, it is possible to increase effective resolution (dot density) of the medium 12 in the X-direction, for example, compared to a configuration in which the plurality of nozzles N are arranged in the X-direction.

Figure 5:
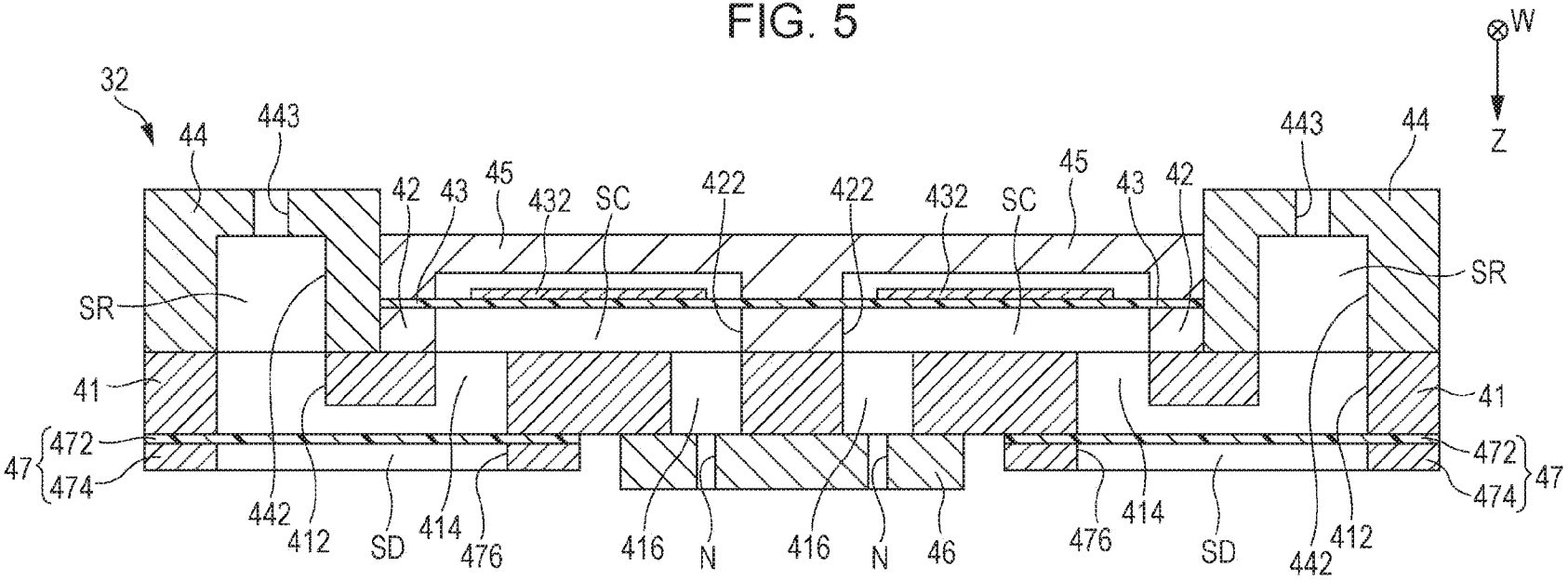
FIG. 5 is a cross-sectional view of a liquid ejection section illustrated in FIG. 4.

Here, a configuration example of the liquid ejection section 32 illustrated in FIG. 4 will be described in detail with reference to FIG. 5. Moreover, since all the plurality of liquid ejection sections 32 illustrated in FIG. 4 have the same configuration, one of the liquid ejection sections 32 will be described here. FIG. 5 is a sectional view illustrating a cross section configuration of the liquid ejection section 32 orthogonal to the W-direction. As illustrated in FIG. 5, the liquid ejection section 32 of the first embodiment is a laminated structure. Here, the liquid ejection section 32 includes two nozzles N and is configured such that structures supplying and ejecting the liquid to each nozzle N are respectively disposed in line symmetry with respect to a symmetry axis parallel to the W-direction. However, the liquid ejection section 32 is not necessarily limited to the structure and may be formed of a structure corresponding to one nozzle N, or may be a structure in which the nozzles N are arranged zigzag between two rows in the W-direction. The liquid ejection section 32 includes a flow path substrate 41 as one example of the flow path member. A pressure chamber substrate 42, a vibration plate 43, a housing 44, and a sealing plate 45 are disposed on one side (negative side in the Z-direction) of the flow path substrate 41. The nozzle plate 46 and a compliance section 47 are disposed on the other side of the flow path substrate 41. Each element of the liquid ejection sections 32 is a substantially flat member that is substantially long in the W-direction and the elements are fixed to each other, for example, by adhesive.

The nozzle plate 46 of FIG. 5 is a substrate in which the plurality of nozzles N are formed. The nozzle plate 46 of the first embodiment is a flat plate that is long in the W-direction also as illustrated in FIG. 4 and, for example, is formed of a silicon single crystal substrate. Specifically, as illustrated in FIG. 3, the plurality of nozzles N arranged in the two rows in the W-direction are formed in the nozzle plate 46 of each liquid ejection section 32.

The flow path substrate 41 of FIG. 5 is a flat plate configuring the flow path of the ink. An opening section 412, a supply flow path 414, and a communication flow path 416 are formed in the flow path substrate 41 of the first embodiment. The supply flow path 414 and the communication flow path 416 are through-holes formed for each nozzle N and the opening section 412 is a through-hole which is continuous over the plurality of nozzles N. A space that allows an accommodating section (concave section) 442 formed in the housing 44 and the opening section 412 of the flow path substrate 41 functions as a storage chamber (reservoir) SR storing the ink supplied from the liquid container 14 through an introduction flow path 443 of the housing 44.

The compliance section 47 of FIG. 5 is an element for suppressing pressure variation of the ink within the storage chamber SR and includes an elastic film 472 and a support plate 474. The elastic film 472 is a flexible member formed in a film shape and configures a wall surface (specifically, a bottom surface) of the storage chamber SR. The support plate 474 is a flat plate formed of a material having high rigid such as stainless steel and supports the elastic film 472 on the surface of the flow path substrate 41 such that the opening section 412 of the flow path substrate 41 is closed by the elastic film 472. An opening section 476 is formed in a region overlapping the storage chamber SR in the support plate 474 while interposing the elastic film 472 therebetween. The elastic film 472 is deformed depending on the pressure of the ink within the storage chamber SR in a space (hereinafter, referred to as "damper chamber") SD on an inside of the opening section 476 of the support plate 474 and thereby the pressure variation within the storage chamber SR is suppressed (absorbed). That is, the damper chamber SD functions as a space for deforming the elastic film 472 so that the pressure variation within the storage chamber SR is absorbed.

An opening section 422 is formed in the pressure chamber substrate 42 of FIG. 5 for each nozzle N. The vibration plate 43 is a flat plate to be elastically vibrated and is fixed to a surface on a side opposite to the flow path substrate 41 in the pressure chamber substrate 42. A space interposed between the vibration plate 43 and the flow path substrate 41 on an inside of each opening section 422 of the pressure chamber substrate 42 functions as a pressure chamber (cavity) SC which is filled with the ink supplied from the storage chamber SR through the supply flow path 414. Each pressure chamber SC communicates with the nozzle N through the communication flow path 416 of the flow path substrate 41. Furthermore, a piezoelectric element 432 is formed on a surface of the vibration plate 43 on a side opposite to the pressure chamber substrate 42 for each nozzle N. Each piezoelectric element 432 is a driving element where a piezoelectric layer is interposed between electrode layers facing each other. A plurality of piezoelectric elements 432 are sealed by the sealing plate 45.

Figure 6:
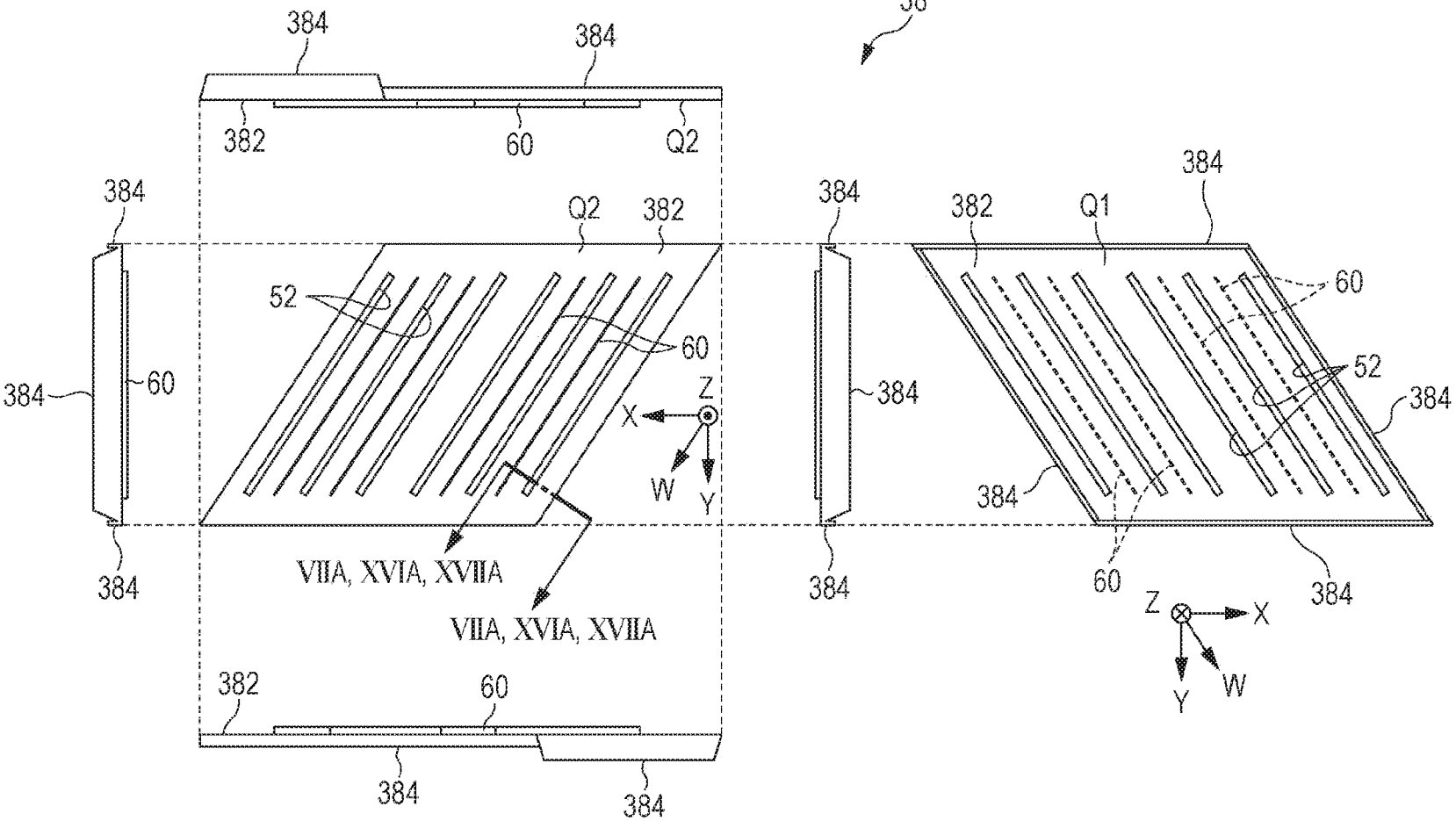
FIG. 6 is a six-orthogonal view illustrating a configuration example of a fixing plate illustrated in FIG. 4.

The plurality of liquid ejection sections 32 having the structure illustrated above are fixed to the fixing plate 38 of FIG. 4. FIG. 6 is a configuration view (six-orthogonal view) of the fixing plate 38. As illustrated in FIGS. 4 and 6, the fixing plate 38 of the first embodiment includes a support section 382 and a plurality of peripheral sections 384. The support section 382 is a flat plate-shaped portion including a first surface Q1 and a second surface Q2 positioned on opposite sides to each other. As illustrated in FIG. 6, the support section 382 of the first embodiment is formed in a rectangular shape (specifically, parallelogram-shaped) that is defined by a pair of edges extending in the W-direction and a pair of edges extending in the X-direction. The first surface Q1 of the support section 382 is a surface on the negative side in the Z-direction and the second surface Q2 is a surface on the positive side (medium 12 side) in the Z-direction. The second surface Q2 of the support section 382 is water-repellent processed. On the other hand, each peripheral section 384 is a portion that is continuous to each edge of the support section 382 and is bent on the negative side in the Z-direction so as to be substantially orthogonal to the first surface Q1 or the second surface Q2 of the support section 382. For example, the support section 382 and the plurality of peripheral sections 384 are integrally configured by bending the flat plate that is molded in a predetermined shape by a material having high rigidity such as stainless steel.

Figure 7A:
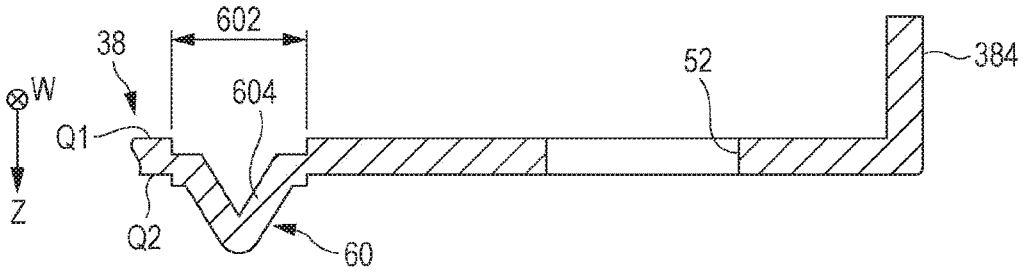
FIGS. 7A and 7B are views describing a relationship between the fixing plate and the liquid ejection section illustrated in FIG. 6.
Figure 7B:
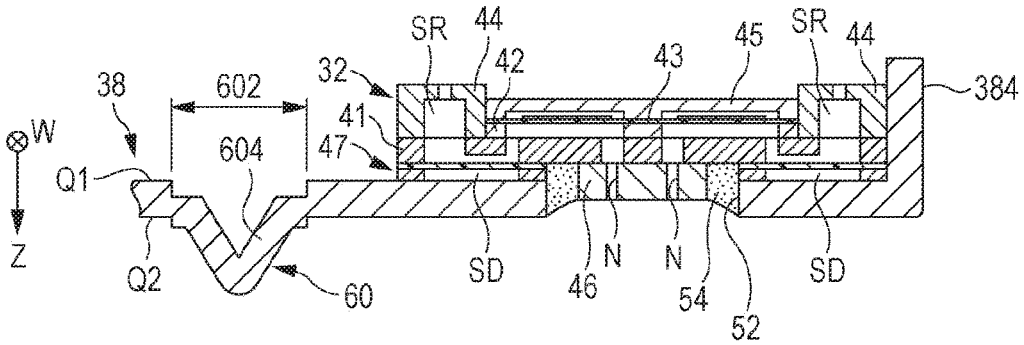

FIGS. 7A and 7B are views describing a relationship between the fixing plate 38 (support section 382) and the liquid ejection section 32. FIG. 7A is a sectional view of the fixing plate 38 before attaching the liquid ejection section 32 and corresponds to a sectional view taken along line VIIA-VIIA in FIG. 6. FIG. 7B is a sectional view of a case where the liquid ejection section 32 is attached to the fixing plate 38 illustrated in FIG. 7A. As illustrated in FIG. 7B, the plurality of liquid ejection sections 32 of the liquid ejecting head 30 is fixed to the first surface Q1 of the support section 382 of the fixing plate 38 so that the nozzle plate 46 exposes to the opening section 52 of the fixing plate 38 illustrated in FIG. 7A. Then, as described above, in a state where the plurality of liquid ejection sections 32 are fixed to the first surface Q1 of the support section 382, each peripheral section 384 of the fixing plate 38 is fixed to the support body 34 illustrated in FIG. 4, for example, by adhesive. The plurality of liquid ejecting heads 30 having the structure illustrated above are arranged in the X-direction in a state where the second surface Q2 of the fixing plate 38 faces the positive side in the Z-direction as illustrated in FIG. 3. As will be understood from the description above, the plane of the plurality of liquid ejecting heads 30 configured of the second surface Q2 corresponds to the liquid ejection surface.

As illustrated in FIGS. 6, 7A, and 7B, the opening section 52 exposing the nozzle plate 46 of the embodiment is formed in the support section 382 of the fixing plate 38 configuring a surface facing the medium 12. The plurality (six) of opening sections 52 corresponding to each liquid ejection section 32 are formed in the support section 382 and the opening sections 52 are respectively arranged in the X-direction at predetermined intervals to each other. Each opening section 52 is an elongated through-hole extending in the W-direction when viewed in a plan view (viewed in a direction perpendicular to the Z-direction). As illustrated in FIG. 3, in a state where the nozzle plate 46 of each liquid ejection section 32 is positioned on the inside of one opening section 52, each liquid ejection section 32 is fixed to the first surface Q1 of the support section 382. As will be understood from the description above, each opening section 52 of the fixing plate 38 is a through-hole for exposing the plurality of nozzles N of each liquid ejection section 32. As illustrated in FIGS. 7A and 7B, a space (specifically, an interval between an inner peripheral surface of the opening section 52 and an outer peripheral surface of the nozzle plate 46) on the inside of the opening section 52 is filled with a filling material 54 formed of, for example, a resin material. Thus, there is an advantage that a possibility of entering and staying of a large amount of ink in the space on the inside of the opening section 52 can be reduced compared to a configuration that does not form the filling material 54. On the other hand, in a configuration forming the filling material 54 with a hydrophilic resin material, there is a situation that the ink ejected from each nozzle N is likely to adhere to a surface of the filling material 54.

As illustrated in FIGS. 7A and 7B, in the first embodiment, a surface of the support plate 474 of the compliance section 47 on a side opposite to the elastic film 472 is fixed to the first surface Q1 of the fixing plate 38, for example, by adhesive. That is, the opening section 476 of the support plate 474 is closed by the first surface Q1 of the fixing plate 38. A space interposed between the elastic film 472 and the first surface Q1 on the inside of the opening section 476 of the support plate 474 functions as the damper chamber SD for vibrating the elastic film 472.

As illustrated in FIGS. 6, 7A, and 7B, the protrusion section 60 of the embodiment is formed in the support section 382 of the fixing plate 38 configuring the surface facing the medium 12. A plurality (four) of protrusion sections 60 are formed in the support section 382 and each protrusion section 60 protrudes from the second surface Q2 of the fixing plate 38 on the positive side (medium 12 side) in the Z-direction. As illustrated in FIG. 3, the plurality of protrusion sections 60 of the first embodiment are disposed on an inside of the nozzle distribution region R in the liquid ejection surface. specifically, each protrusion section 60 is formed in a region between each opening section 52 and each opening section 52 adjacent to each other in the X-direction, and extends in the W-direction similar to each opening section 52. That is, each protrusion section 60 is formed in an elongated shape (linear shape) of which a dimension in the W-direction exceeds a dimension in a direction orthogonal to the W-direction within the X-Y plane. The dimension (total length) of the protrusion section 60 in the W-direction is equal to a dimension of the opening section 52 in the W-direction. As will be understood from FIG. 6, the protrusion section 60 is not formed in a region between each peripheral section 384 (each edge of the support section 382) and the opening section 52 in the support section 382 of the fixing plate 38. Thus, it is possible to reduce a possibility of occurrence of an error in each position of the opening section 52 and the protrusion section 60 or on a positional relationship therebetween due to bending of the peripheral section 384. In addition, there is also an advantage that bending of the peripheral section 384 is easily performed compared to a configuration in which the protrusion section 60 is formed between the peripheral section 384 and the opening section 52.

As illustrated in FIGS. 7A and 7B, each liquid ejection section 32 is disposed in a position that does not overlap each protrusion section 60 when viewed in a plan view. Specifically, the support plate 474 bonded to the first surface Q1 of the fixing plate 38 in the liquid ejection section 32 does not overlap each protrusion section 60 on the second surface Q2 side when viewed in a plan view. Furthermore, the damper chamber SD of each protrusion section 60 does not overlap each protrusion section 60 when viewed in a plan view. In a configuration in which the damper chamber SD of each protrusion section 60 overlaps the protrusion section 60 when viewed in a plan view, the damper chamber SD communicates with a space on the inside of the protrusion section 60 and errors may occur in characteristics (volume and pressure) of the damper chamber SD. In the first embodiment, since each protrusion section 60 does not overlap the damper chamber SD when viewed in a plan view, it is possible to equalize the characteristics of each damper chamber SD.

Each protrusion section 60 of the first embodiment is integrally formed with the fixing plate 38. Specifically, each protrusion section 60 is formed by drawing with respect to the fixing plate 38. Drawing is a type of press processing of a metal flat plate and is a processing method of forming the protrusion by pressing a punch on a surface of the metal flat plate that is a material of the fixing plate 38. Thus, distortion or undulation (warpage) is likely to occur as a thickness of the flat plate to be processed is thin and there is a problem that a flatness is lowered. Then, in the first embodiment, when forming a protrusion 604 by drawing in the fixing plate 38, a stepped region 602 having a height different from that of the plane surface region (for example, the first surface Q1) is also formed. Thus, as described below, it is possible to suppress or correct distortion due to drawing (press processing) and then it is possible to ensure the flatness of the flat plate after press processing. Moreover, as described below, one of the protrusion 604 and the stepped region 602 may be formed earlier. The stepped region 602 includes not only the region of which the length is already different from that of the plane surface region (for example, the first surface Q1) but also a region to be different. Furthermore, for the sake of convenience, in the protrusion section 60 illustrated in FIGS. 3, 4, and 6 described above, the stepped region 602 and the protrusion 604 are indicated in straight lines.

The stepped region 602 of the first embodiment is formed so as to protrude from the second surface Q2 of the fixing plate 38 on the liquid ejection side (protrusion 604 side). However, the stepped region 602 may protrude on a side opposite to the liquid ejection side (protrusion 604 side). The stepped region 602 is formed, for example, by half-blanking. If the stepped region 602 is formed in the flat plate (fixing plate 38) by half-blanking, it is possible to form the stepped region 602 by stopping in the middle of a thickness that is not punched when pressing the punch on the flat plate. In this case, a pressing amount of the punch is an extent to which a side surface of the stepped region 602 can maintain a shear surface. If the pressing amount of the punch exceeds a predetermined amount, a fracture surface occurs in the side surface of the stepped region 602. Thus, it is preferable that the pressing amount of the punch is a pressing amount of an extent to which the fracture surface does not occur on the side surface of the stepped region 602. Moreover, the stepped region 602 is not limited to a case in which the stepped region 602 is formed by half-blanking. For example, the stepped region 602 may be formed by etching. Moreover, details of a forming method of the protrusion section 60 will be described below.

Figure 8:
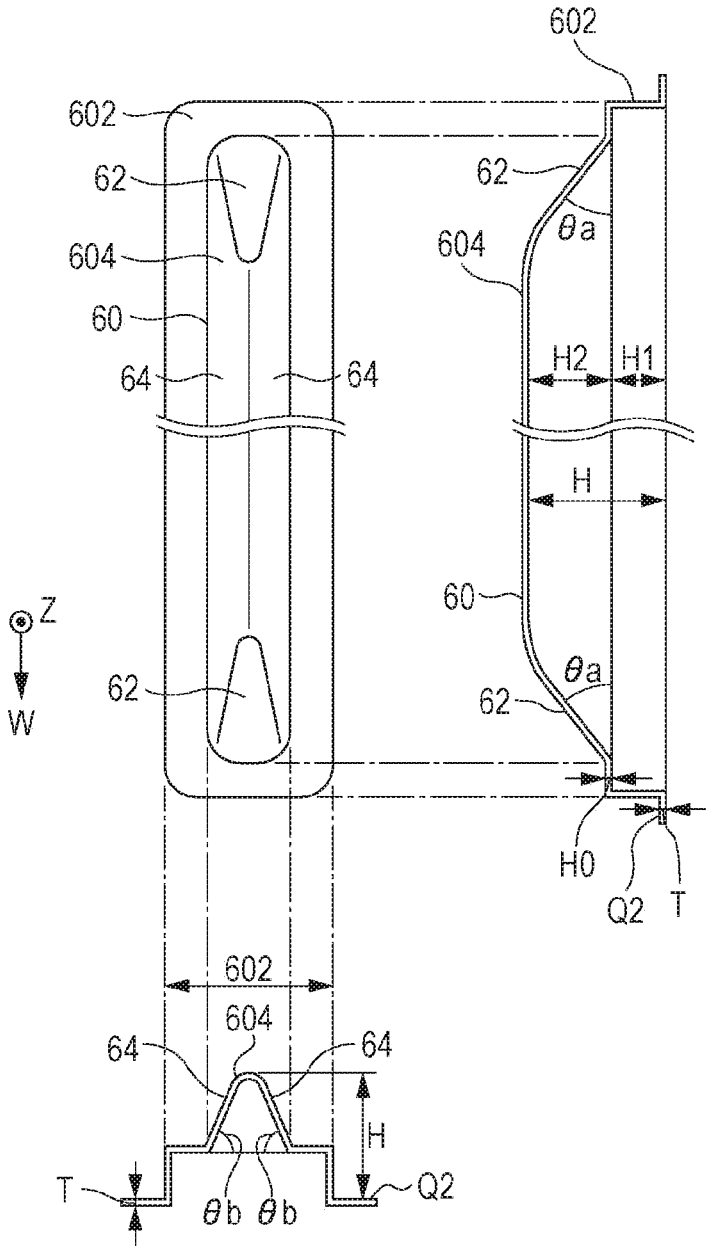
FIG. 8 is an enlarged view of a protrusion section illustrated in FIGS. 7A and 7B.

FIG. 8 is an enlarged view illustrating a specific example of a shape of arbitrary one protrusion section 60. As illustrated in FIG. 8, the protrusion 604 of the protrusion section 60 is disposed within the stepped region 602 described above. The protrusion 604 is a three-dimensional structure including end surfaces 62 positioned on both end sides in the W-direction (that is, a longitudinal direction of the protrusion section 60) and side surfaces 64 positioned between the both ends. A top section crossing each side surface 64 in the protrusion 604 is molded in a curved shape. In FIG. 8, a cross section parallel to the W-direction and a cross section perpendicular to the W-direction are illustrated together. As will be understood from each cross section, an angle θa of the end surface 62 of the protrusion 604 with respect to the second surface Q2 is smaller than an angle θb of the side surface 64 of the protrusion 604 with respect to the second surface Q2. That is, each end surface 62 of the protrusion 604 is a gently inclined surface compared to the side surface 64.

As illustrated in FIG. 8, a height H of the protrusion section 60 with respect to the second surface Q2 is formed by adding a height H1 of a portion that is pressed out on the second surface Q2 by half-blanking to a height H2 of the protrusion 604 that is pressed out on the second surface Q2 side further to the height H1. As described above, the protrusion section 60 of the embodiment can compensate for a part of the height H of the height H1 of the stepped region. Thus, it is possible to ensure the height H of the protrusion section 60 to the height H2 or more of the protrusion 604 formed by drawing.

The height H2 of the protrusion 604 is substantially constant in a segment other than the end surface 62 in a total length in the W-direction. Specifically, the height H2 is maintained at a predetermined value through a segment of 90% or more of the total length of the protrusion 604 in the W-direction. As illustrated in FIG. 8, the height H of the protrusion section 60 is greater than a plate thickness T of the fixing plate 38 (support section 382) (H>T). Specifically, the plate thickness T of the fixing plate 38 is approximately 0.08 mm and the height H of the protrusion section 60 is approximately 0.4 mm to 0.6 mm. Furthermore, as described above, since the second surface Q2 of the fixing plate 38 is water-repellent processed, water-repellent property is also given to a surface (each end surface 62 and each side surface 64) of each protrusion section 60 formed on the second surface Q2. Thus, there is an advantage that a possibility of remaining of the ink on the surface of the protrusion section 60 can be reduced.

In the protrusion section 60 of the first embodiment, since the protrusion 604 is formed within the stepped region 602, a relationship between the height and the thickness of the stepped region 602 is as follows. That is, the protrusion amount H2 of the protrusion 604 from the stepped region 602 is greater than the stepped amount H1 of the stepped region 602 from the plane surface region (second surface Q2). Furthermore, the protrusion amount H2 of the protrusion 604 is greater than a thickness (average thickness of the stepped region) H0 of the stepped region 602. Thus, it is possible to ensure a predetermined height in the protrusion section 60.

As described above, the protrusion section 60 of the first embodiment is formed together with the stepped region 602 of which the height is different from that of the plane surface region (first surface Q1) of the fixing plate 38. Thus, distortion due to drawing (press processing) is suppressed or corrected and thereby it is possible to guarantee the flatness of the fixing plate 38. Thus, it is possible to manufacture the liquid ejecting head 30 in which the flatness of the fixing plate 38 is maintained.

Figure 9:
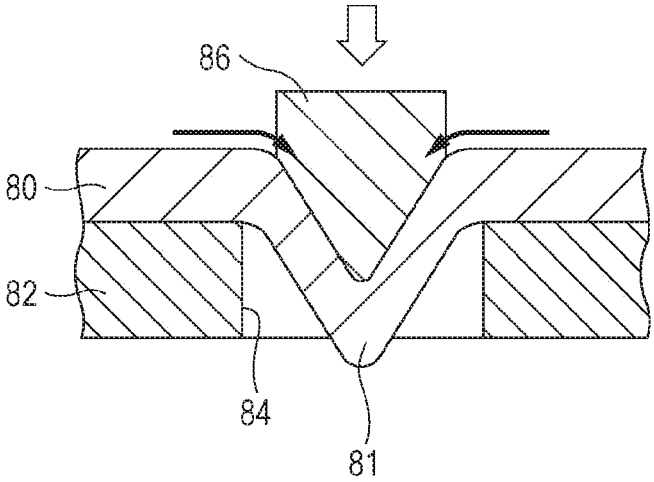
FIG. 9 is a view describing a comparison example of the first embodiment and is a sectional view that is taken when the protrusion section is formed only by drawing.

Here, a case where only the protrusion section 60 is formed by drawing without forming the stepped region 602 described above will be described in detail as a comparison example of the embodiment. FIG. 9 is a sectional view illustrating the comparison example of a case where the protrusion section 60 is formed on a flat plate 80 by drawing. As illustrated in FIG. 9, for forming a protrusion 81 of the protrusion section 60 in the flat plate 80 by drawing, a dies 82 in which a blade hole 84 is formed is installed on one surface of the flat plate 80. A punch 86 including a protrusion is disposed on the other surface of the flat plate 80 and is pressed into the blade hole 84 of the dies 82. When pressing the punch 86 to the flat plate 80, as illustrated by arrows in FIG. 9, distortion or undulation (warpage) occurs on a surface of the flat plate 80 and the flatness of the flat plate 80 is lowered by drawing a peripheral surface. Thus, before performing drawing, for example, as illustrated in FIG. 7A, if the opening section 52 is formed in the flat plate 80, the flatness thereof is lowered, a center is shifted in the opening section 52 in the vicinity thereof, or a shape thereof may be deformed when performing drawing. The peripheral surface is largely drawn by drawing as a thickness of the flat plate 80 is thin and as a height of the protrusion 81 is high with respect to a thickness of the flat plate 80. Thus, distortion or warpage is likely to occur in the flat plate 80 and the flatness of the flat plate 80 is likely to be lowered.

Thus, it is possible to suppress a decrease in the flatness due to drawing some extent by increasing the thickness of the flat plate 80. However, since it is the fixing plate 38 defining the liquid ejection surface (nozzle surface) by exposing the nozzle plate 46 from the opening section 52, in which drawing is performed in the embodiment, a step between the fixing plate 38 and the nozzle plate 46 is increased as the thickness thereof is increased. For example, there is a problem that a wiping property is worsened when wiping a surface of the fixing plate 38 that is the liquid ejection surface by a wiper or the surface of the nozzle plate 46 is separated from the medium 12 and then precision of a landing position of the ink is lowered as a step between the fixing plate 38 and the nozzle plate 46 is large.

In this regard, in the first embodiment, when performing the protrusion 604 by drawing, since the stepped region 602 is also formed, as described below, it is possible to suppress or correct distortion by drawing (press processing). Thus, in the embodiment, it is possible to guarantee the flatness of the fixing plate 38 without excessively increasing the thickness of the fixing plate 38.

Furthermore, in the first embodiment, such a protrusion section 60 is formed so as to protrude from the second surface Q2 of the fixing plate 38 on the positive side (medium 12 side) in the Z-direction. Thus, for example, as illustrated by the broken line in FIG. 2, when the medium 12 is deformed (for example, curled) on the liquid ejecting unit 26 side between the first rollers 242 and the second rollers 244, even if the medium 12 comes into contact with the protrusion section 60, the medium 12 does not come into contact with the second surface Q2 of the fixing plate 38 because the medium 12 does not reach the second surface Q2. Thus, it is possible to greatly reduce a possibility that the ink remaining on the surface of the fixing plate 38 in the vicinity (particularly, the filling material 54) of the opening section 52 or the surface of the nozzle plate 46 adheres to the medium 12.

Furthermore, the stepped region 602 of the first embodiment is formed so as to protrude from the second surface Q2 of the fixing plate 38 on the liquid ejection side (protrusion 604 side). Thus, it is possible to effectively increase the total height H of the protrusion section 60 compared to a case where the stepped region 602 protrudes on a side opposite to a liquid ejection side (protrusion 604 side). As the protrusion section 60 of the first embodiment, the protrusion amount (height of the protrusion 604) H2 of the protrusion section 60 from the stepped region 602 is greater than the stepped amount (height of the stepped region) H1 of the stepped region 602 from the plane surface region (first surface Q1). Thus, it is possible to effectively increase the height H of the protrusion section 60 by the protrusion amount (height) H2 of the protrusion 604. Furthermore, the protrusion amount (height) H of the protrusion section 60 is greater than the thickness H0 of the stepped region 602. Thus, it is possible to always allow the protrusion 604 to protrude from the stepped region 602. Therefore, it is possible to form the protrusion section 60 having the height that is effective to reduce a possibility that the ink remaining on the surface of the fixing plate 38 in the vicinity (particularly, the filling material 54) of the opening section 52 adheres the medium 12.

It is possible to reduce the possibility that the medium 12 comes into contact with the opening section 52 as the protrusion section 60 is closer to the opening section 52 that is exposed by the nozzle plate 46. Therefore, it is possible to further reduce the possibility that the ink remaining on the inside of the opening section 52 adheres to the medium 12. In this regard, in the first embodiment, the protrusion section 60 is directly formed in the fixing plate 38 in which the opening section 52 is formed. Thus, it is possible to greatly reduce a distance between the opening section 52 and the protrusion section 60 of the fixing plate 38 compared to a configuration in which the protrusion section 60 is formed in an element separated from the fixing plate 38. Therefore, the effect described above that it is possible to reduce the possibility that the ink remaining the inside of the opening section 52 adheres the medium 12 is particularly remarkable. Furthermore, as described above, since the distance between the opening section 52 and the protrusion section 60 of the fixing plate 38 is decreased, it is also possible to reduce the height H of the protrusion section 60 that is necessary for preventing the ink remaining on the inside of the opening section 52 from adhering to the medium 12. Thus, it is possible to further reduce a required interval (so-called platen gap) between the medium 12 and the fixing plate 38. Therefore, there is also an advantage that it is possible to effectively reduce the error of the landing position of the ink on the surface of the medium 12.

Furthermore, as described above, the fixing plate 38 of the first embodiment is fixed to the nozzle plate 46 through members (specifically, the flow path substrate 41 and the compliance section 47) other than the nozzle plate 46. That is, both the fixing plate 38 and the nozzle plate 46 are disposed on one side (positive side in the Z-direction) of the flow path substrate 41. Thus, for example, it is possible to reduce the interval between the medium 12 and the nozzle plate 46 compared to a configuration in which the fixing plate 38 is directly bonded to the surface of the nozzle plate 46. Therefore, there is also an advantage that it is possible to effectively reduce the error of the landing position of the ink on the surface of the medium 12. Furthermore, since the plurality of liquid ejection sections 32 are fixed to the common fixing plate 38, for example, there is an advantage that it is possible to adjust a positional relationship between the liquid ejection sections 32 with high precision compared to a configuration in which each liquid ejection section 32 is fixed to an individual member.

Furthermore, in the first embodiment, since the height H of the protrusion section 60 exceeds the plate thickness T of the fixing plate 38 (support section 382) (H>T), for example, there is an advantage that it is possible to effectively prevent the medium 12 from coming into contact with the second surface Q2 of the fixing plate 38 compared to a configuration in which the height H of the protrusion section 60 is less than the plate thickness T of the fixing plate 38. In addition, an interval (volume of a space between both) between the inner peripheral surface of the opening section 52 and the outer peripheral surface of the nozzle plate 46 is reduced and it is possible to reduce adhering of the ink to the surface of the filling material 54 with which the interval is filled.

Moreover, in a configuration in which an angle θa of the end surface 62 of the protrusion section 60 is steep (for example, close to a right angle), a leading end of the medium 12 engages a corner portion that is configured of the end surface 62 and the second surface Q2 and thereby it is possible to allow deformation such as wrinkles to occur in the medium 12. In the first embodiment, since an angle θa of the end surface 62 is regulated to be an angle that is smaller than the angle θb of the side surface 64, there is an advantage that it is possible to reduce a possibility (eventually, possibility of deformation of the medium 12) that the leading end of the medium 12 engages the end surface 62.

Manufacturing Method of Liquid Ejecting Head 30

A manufacturing method of the liquid ejecting head 30 illustrated above will be described below. FIGS. 10A to 10D are processing views for manufacturing the liquid ejecting head 30.

Figure 10A:
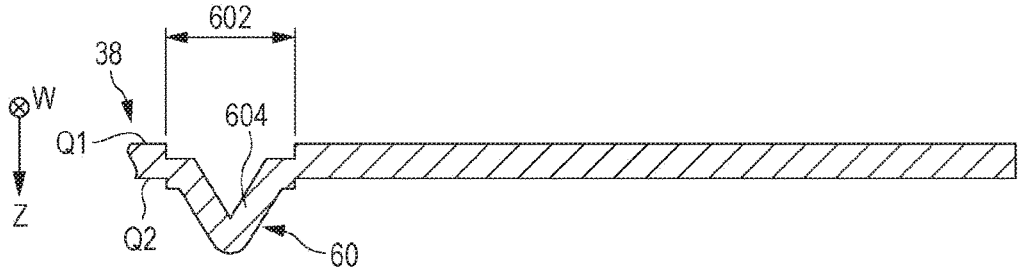
FIGS. 10A to 10D are views illustrating a part of processes of manufacturing the liquid ejecting head.
Figure 10B:
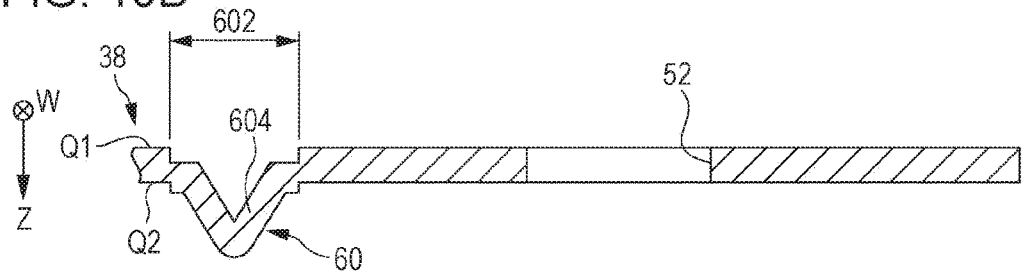
Figure 10C:
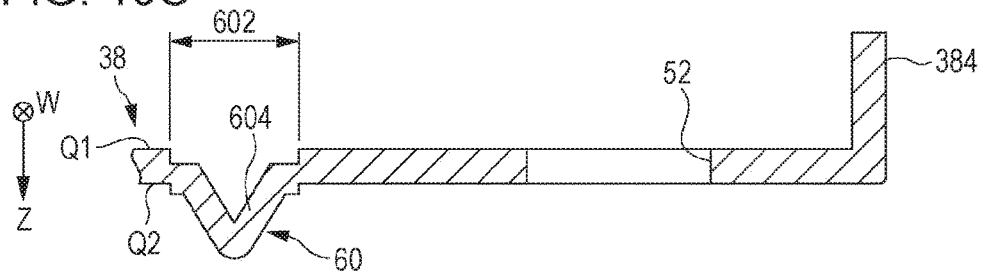

In steps of FIGS. 10A to 10C, the fixing plate 38 is manufactured by press processing or bending a flat plate 110. First, in FIG. 10A, the protrusion section 60 is formed in the flat plate 110. In the first embodiment, the protrusion section 60 is formed by providing the protrusion 604 within the stepped region 602 by drawing. As described above, an influence of distortion due to drawing cannot be affected to the plane surface region other than the stepped region 602 by forming the protrusion 604 by drawing within the stepped region 602. Thus, it is possible to guarantee the flatness of the flat plate. Details of the forming method of the protrusion section 60 will be described later.

Sequentially, in FIG. 10B, the opening section 52 as one example of the through-hole is formed in the flat plate 110. The opening section 52 is formed by punching. However, the opening section 52 is not limited to the example and the opening section 52 may be formed by removing a protruding portion after half-blanking. In the first embodiment, as described above, since it is possible to guarantee the flatness of the flat plate 110 even if the protrusion section 60 is formed, it is possible to form the opening section 52 without receiving the influence of drawing of the protrusion section 60 by forming the opening section 52 after forming the protrusion section 60. Thus, it is possible to form the opening section 52 in the flat plate 110 with further high precision.

Next, in FIG. 10C, the peripheral section 384 is formed in the flat plate 110. The peripheral section 384 is formed by bending. It is possible to form the peripheral section 384 without receiving the influence of drawing of the protrusion section 60 by forming the peripheral section 384 after the protrusion section 60 is formed. Thus, it is possible to form the peripheral section 384 in the flat plate 110 with further high precision.

Figure 10D:
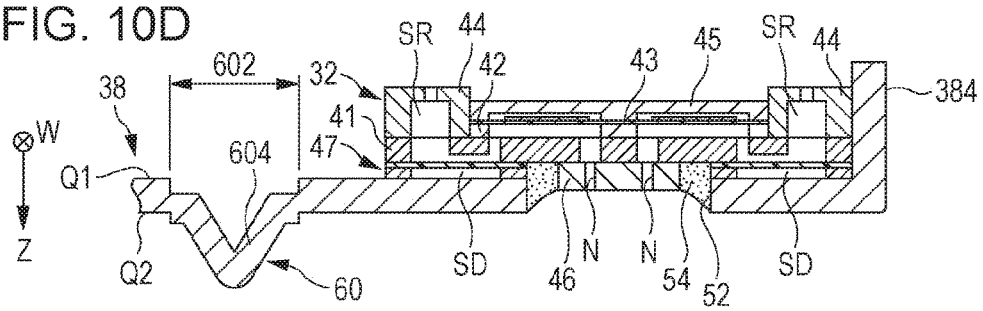

Next, in FIG. 10D, the liquid ejection section 32 including the flow path substrate 41 as the flow path member is fixed to the fixing plate 38 that is manufactured in FIGS. 10A to 10C. The liquid ejection section 32 is fixed to the first surface Q1 (plane surface region) of the support section 382 of the fixing plate 38, for example, by adhesive and the side surface of the flow path substrate 41 is fixed to the peripheral section 384. Thus, it is possible to fix the liquid ejection section 32 to the plane surface region of which the flatness is maintained without receiving the influence of drawing of the protrusion section 60. Therefore, it is possible to further reliably fix the liquid ejection section 32 or the flow path substrate 41. Moreover, even though other steps are not illustrated, the peripheral section 384 of the fixing plate 38 is fixed to the support body 34 connecting the flow path structure 36, for example, by adhesive. Thus, the plurality of liquid ejection sections 32 are fixed to the fixing plate 38 and then the flow path substrate 41 as the flow path member is fixed to the fixing plate 38 through the compliance section 47. Moreover, the flow path substrate 41 may be directly fixed to the fixing plate 38 without through the compliance section 47.

Forming Method of Protrusion Section 60 where Protrusion 604 is Disposed within Stepped Region 602

Here, when forming the fixing plate 38 in the flat plate 110 by performing press processing, a forming method of the protrusion section 60 where the protrusion 604 is formed within the stepped region 602 will be described in more detail. As the forming method of the protrusion section 60, as described above, it is possible to apply the method of forming the protrusion 604 by drawing after forming the stepped region 602 by half-blanking (first method), the method of forming the stepped region 602 by half-blanking after forming the protrusion 604 by drawing (second method), and the method of simultaneously forming the protrusion 604 by drawing and the stepped region 602 by half-blanking (third method). Thus, hereinafter, those methods will be described below in order.

First Method

Figure 11A:
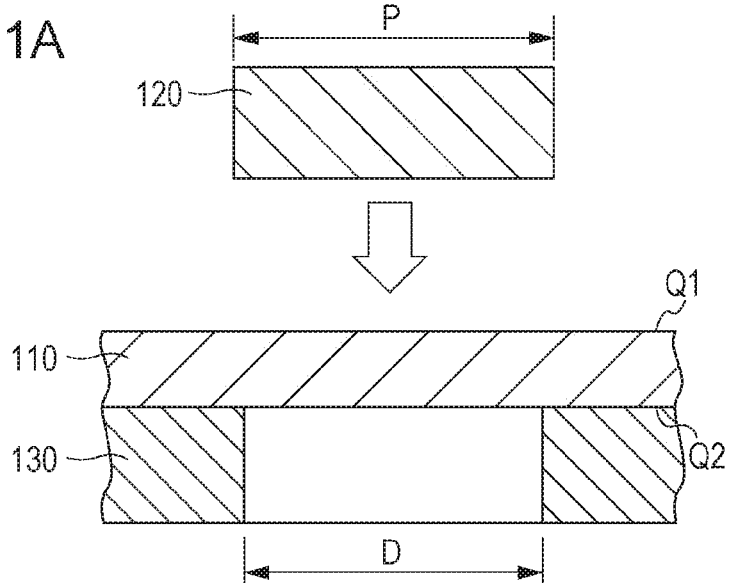
FIGS. 11A to 11C are views describing a first method of forming a protrusion within a stepped region in the fixing plate and processing views of half-blanking for forming the stepped region that is performed earlier.
Figure 11B:
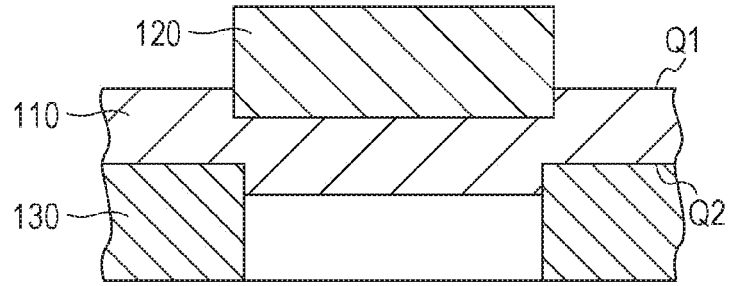
Figure 11C:
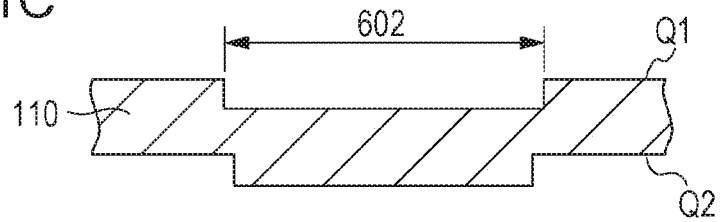
Figure 12A:
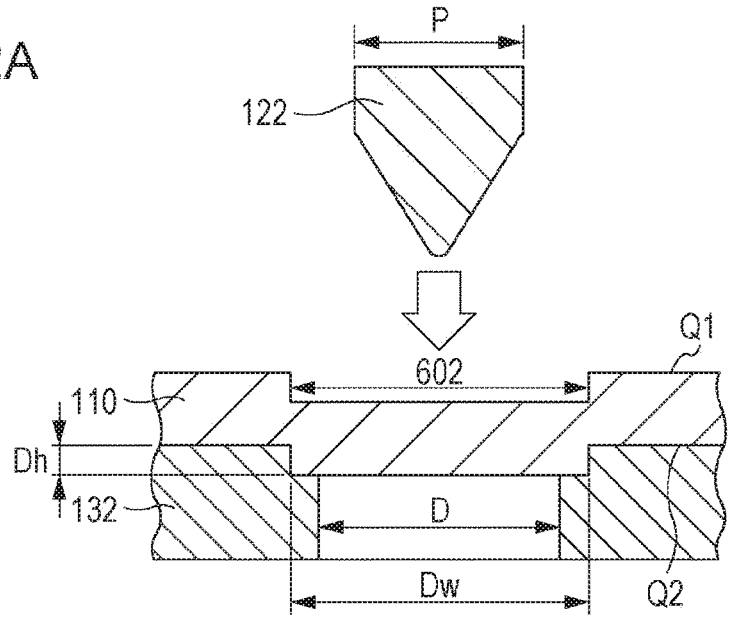
FIGS. 12A to 12C are processing views of drawing for forming the protrusion that is performed subsequent to half-blanking of FIGS. 11A to 11C.
Figure 12B:
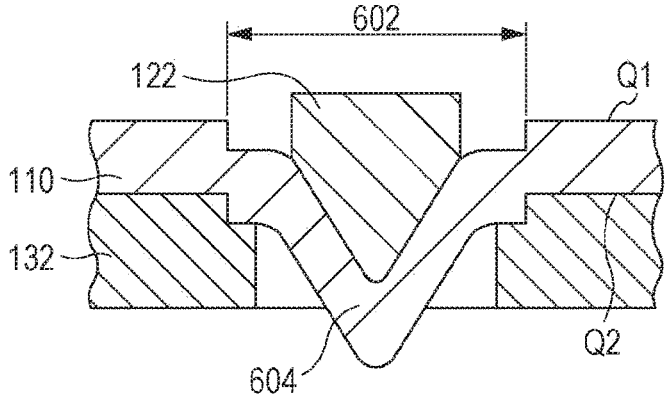
Figure 12C:
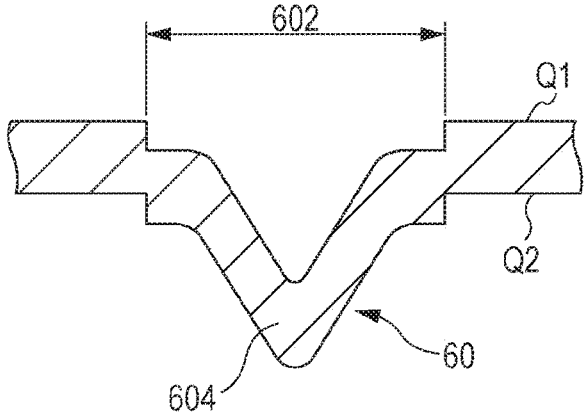

First, the first method of forming the protrusion 604 by drawing after forming the stepped region 602 by half-blanking will be described. FIGS. 11A to 11C and 12A to 12C are processing views describing the first method of forming the protrusion section 60 by the first embodiment. FIGS. 11A to 11C are processing views of half-blanking that is performed earlier and FIGS. 12A to 12C are processing views of drawing that is performed subsequently.

First, as illustrated in FIGS. 11A to 11C, the stepped region 602 is formed by performing half-blanking with respect to the flat plate 110. Half-blanking is performed by using a press mold configured of a punch 120 and a dies 130 that are molded to fit to a shape of the stepped region 602. Here, the punch 120 having a rectangular cross section, of which a blade width is not changed from a base end to a leading end and a leading end surface is a flat surface, is used to fit to the shape of the stepped region 602 illustrated in FIG. 8. For a clearance between a blade width P of the punch 120 and a blade width D of the dies 130 in half-blanking, it is preferable that the blade width P of the punch 120 is slightly greater than the blade width D of the dies 130.

As illustrated in FIG. 11A, the dies 130 is disposed on one surface (second surface Q2) of the flat plate 110 and the punch 120 is disposed on the other surface (first surface Q1) of the flat plate 110. As illustrated in FIG. 11B, the flat plate 110 is pressed out to the dies 130 by pressing the punch 120 by a predetermined pressing amount and then the stepped region 602 is formed. In this case, the predetermined pressing amount of the punch 120 is determined in a range in which a shear surface is formed on an inner surface 603 of the stepped region 602. Thus, it is possible to form the stepped region 602 while maintaining the strength of the flat plate 110. After the punch 120 is pressed to the predetermined pressing amount, the punch 120 is pulled out from the flat plate 110. Then, as illustrated in FIG. 11C, the stepped region 602 is formed in the flat plate 110.

Next, as illustrated in FIGS. 12A to 12C, the protrusion 604 is formed by drawing within the stepped region 602 that is formed by half-blanking earlier. Drawing is performed by using a press mold configured of a punch 122 and a dies 132 that are molded to fit to the shape of the protrusion 604. Here, the convex-shaped punch 122 of which a blade width is gradually reduced from a base end to a leading end is used to fit to the shape of the protrusion 604 illustrated in FIG. 8. For a clearance between a blade width P of the punch 122 and a blade width D of the dies 132 in drawing, it is preferable that the blade width P of the base end of the punch 122 is less than the blade width D of the dies 132. Moreover, in the first method, the stepped region 602 is formed by half-blanking before performing drawing. Thus, as the dies 132 using for drawing of the first method, a step 133, of which a width is greater than the blade width D for drawing, which protrudes from the flat plate 110 on the dies 132 side, and which has a width Dw and a depth Dh to an extent to insert the stepped region 602, is formed on the flat plate 110 of a blade hole.

As illustrated in FIG. 12A, the dies 132 is disposed on one surface (second surface Q2) of the flat plate 110 and the punch 122 is disposed on the other surface (first surface Q1) of the flat plate 110. As illustrated in FIG. 12B, the flat plate 110 is pressed out to the dies 132 by pressing the punch 122 by a predetermined pressing amount and then the protrusion 604 is formed. In this case, the predetermined pressing amount of the punch 122 is determined according to the height of the protrusion 604. After the punch 122 is pressed to the predetermined pressing amount, the punch 122 is pulled out from the flat plate 110. Then, as illustrated in FIG. 12C, the protrusion 604 is formed within the stepped region 602 and then the protrusion section 60 according to the embodiment is formed in the flat plate 110. Then, it is possible to form the plurality of protrusion sections 60 in the flat plate 110 by performing the processes of FIGS. 11A to 11C and 12A to 12C for the plurality of protrusion sections 60. Moreover, if the plurality of protrusion sections 60 are formed in the same flat plate 110, after forming the plurality of stepped regions 602 earlier by repeating the processes of FIGS. 11A to 11C, the protrusion 604 is formed in each stepped region 602 by repeating the processes of FIGS. 12A to 12C. Thus, the plurality of protrusion sections 60 may be also formed.

According to the first method of forming such a protrusion section 60, since the protrusion 604 is formed within the stepped region 602 by drawing after forming the stepped region 602 by half-blanking, even if material flow is generated by drawing, it is possible to suppress the material flow within the stepped region 602 that is sheared by half-blanking. Thus, it is possible to suppress the material flow around the stepped region 602. Then, distortion due to drawing (press processing) is suppressed and thereby it is possible to guarantee the flatness of the flat plate 110. Furthermore, since for the plurality of protrusion sections 60, each stepped region 602 is formed in a portion in which the protrusion 604 is formed, it is possible to suppress warpage of the flat plate 110 and to improve durability (strength) of the plane by an effect of bead processing by formation of the stepped region 602.

Second Method

Figure 13A:
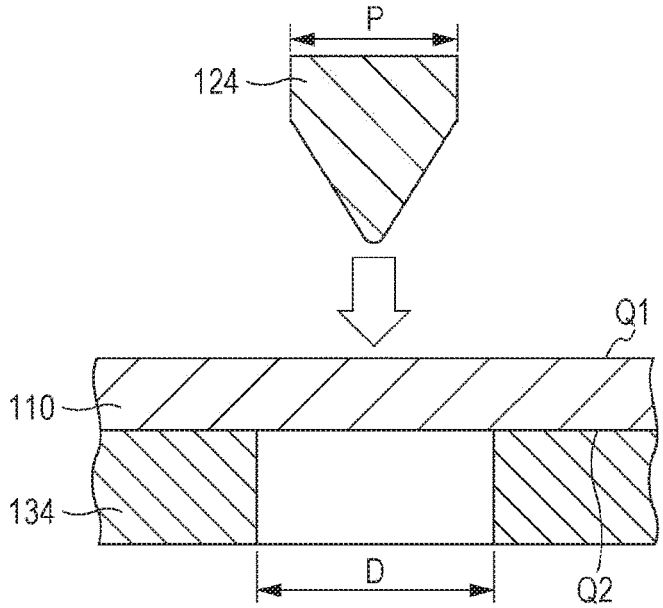
FIGS. 13A to 13C are views describing a second method of forming the protrusion within the stepped region in the fixing plate and processing views of drawing for forming the protrusion that is performed earlier.
Figure 13B:
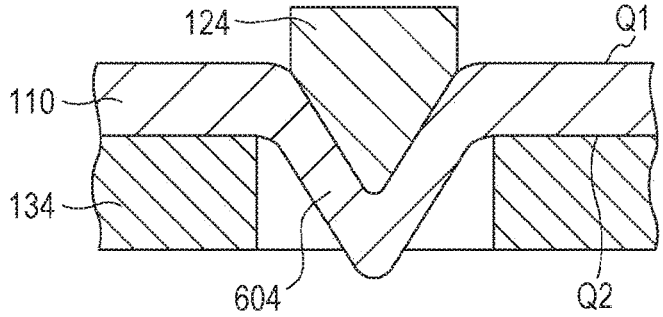
Figure 13C:
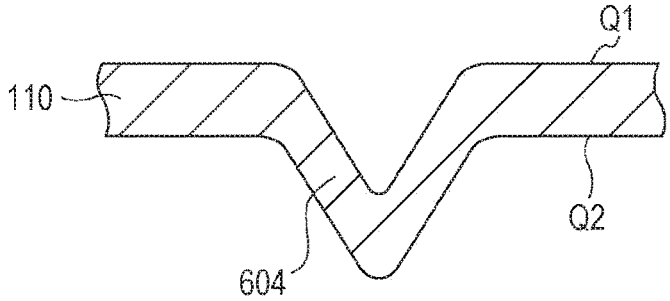
Figure 14A:
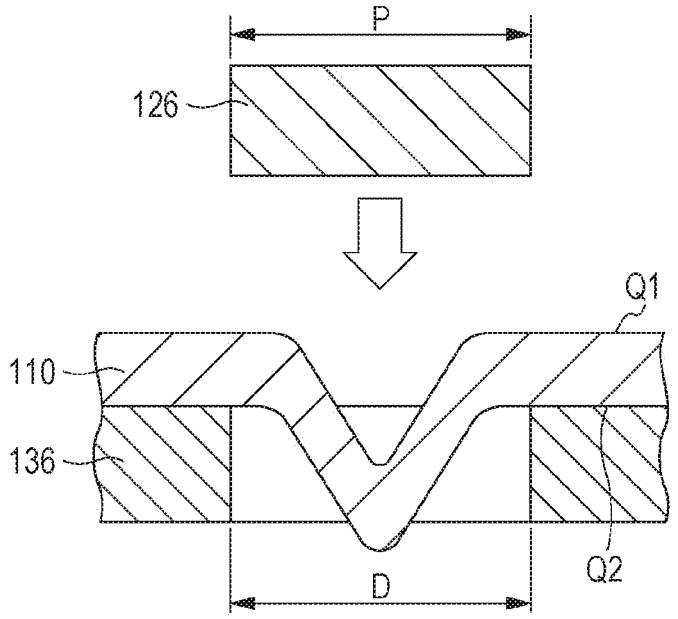
FIGS. 14A to 14C are processing views of half-blanking for forming the stepped region that is performed subsequent to drawing of FIGS. 13A to 13C.
Figure 14B:
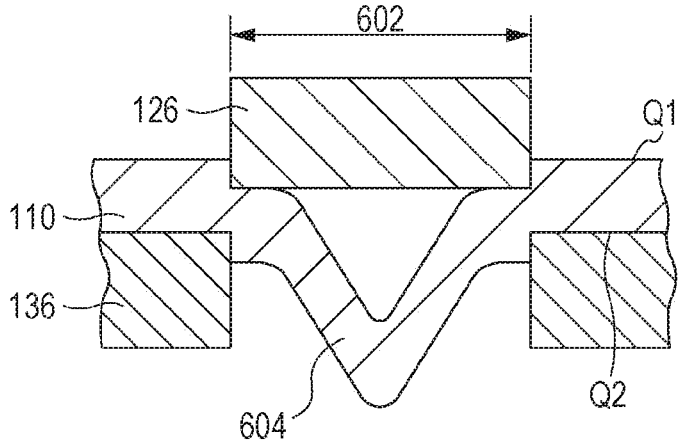
Figure 14C:
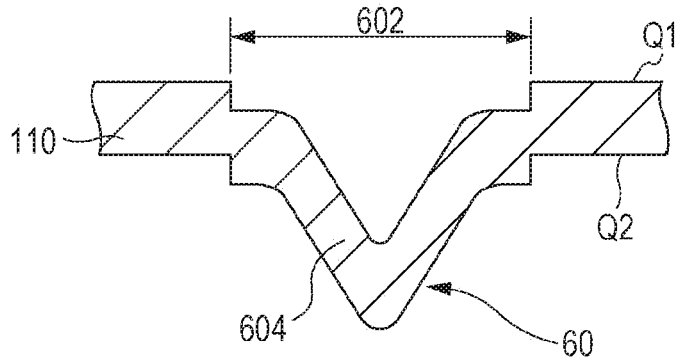

A second method of forming the stepped region 602 by half-blanking after forming the protrusion 604 by drawing will be described. FIGS. 13A to 13C and 14A to 14C are processing views describing the second method of forming the protrusion section 60 by the first embodiment. FIGS. 13A to 13C are processing views of drawing that is performed earlier and FIGS. 14A to 14C are processing views of half-blanking that is performed subsequently.

First, as illustrated in FIGS. 13A to 13C, the protrusion 604 is formed by performing drawing. Drawing is performed by using a press mold that is configured of a punch 124 and a dies 134 to fit to a shape of the protrusion 604. Here, as the punch 124, in order to fit to the shape of the protrusion 604 illustrated in FIG. 8, it is possible to use the punch 122 having the same shape as that in FIGS. 12A to 12C by the first method. For a clearance between a blade width P of the punch 124 and a blade width D of the dies 134 in drawing, it is preferable that the blade width P of a base end of the punch 124 is less than the blade width D of the dies 134.

As illustrated in FIG. 13A, the dies 134 is disposed on one surface (second surface Q2) of the flat plate 110 and the punch 124 is disposed on the other surface (first surface Q1) of the flat plate 110. As illustrated in FIG. 13B, the punch 124 is pressed by a predetermined pressing amount, the flat plate 110 is pressed out and protrudes to the dies 134, and then the protrusion 604 is formed. In this case, the predetermined pressing amount of the punch 124 is determined according to the height of the protrusion 604. After the punch 124 is pressed to the predetermined pressing amount, the punch 124 is pulled out from the flat plate 110. Then, as illustrated in FIG. 13C, the protrusion 604 is formed within the stepped region 602.

Next, as illustrated in FIGS. 14A to 14C, the stepped region 602 is formed by performing half-blanking with respect to the flat plate 110 so as to include the protrusion 604 formed by drawing earlier. Half-blanking is performed by using a press mold configured of a punch 126 and a dies 136 that are mold to fit to the shape of the stepped region 602. Here, it is possible to use the punch 120 having the same shape as that of FIGS. 11A to 11C by the first method to fit to the shape of the stepped region 602 illustrated in FIG. 8. For a clearance between a blade width P of the punch 126 and a blade width D of the dies 136 in half-blanking, it is preferable that the blade width P of the punch 126 is slightly greater than the blade width D of the dies 136.

As illustrated in FIG. 14A, the dies 136 is disposed on one surface (second surface Q2) of the flat plate 110 and the punch 126 is disposed on the other surface (first surface Q1) of the flat plate 110. As illustrated in FIG. 14B, the flat plate 110 is pressed out to the dies 136 by pressing the punch 126 by a predetermined pressing amount and then the stepped region 602 is formed. In this case, the predetermined pressing amount of the punch 126 is determined in a range in which a shear surface is formed in the inner surface 603 of the stepped region 602. Thus, it is possible to form the stepped region 602 while maintaining the strength of the flat plate 110. After the punch 126 is pressed to the predetermined pressing amount, the punch 126 is pulled out from the flat plate 110. Then, as illustrated in FIG. 14C, the stepped region 602 including the protrusion 604 is formed in a portion in which the protrusion 604 of the flat plate 110 is formed. Thus, the protrusion section 60 according to the embodiment is formed in the flat plate 110. Then, it is possible to form the plurality of protrusion sections 60 in the flat plate 110 by performing the processes of FIGS. 13A to 13C and 14A to 14C for the plurality of protrusion sections 60. Moreover, if the plurality of protrusion sections 60 are formed in the same flat plate 110, after forming the plurality of protrusions 604 earlier by repeating the processes of FIGS. 13A to 13C, the protrusion 604 is formed within each stepped region 602 by repeating the processes of FIGS. 14A to 14C. Thus, the plurality of protrusion sections 60 may be also formed.

According to the second method of forming such a protrusion section 60, since the stepped region 602 is formed so as to include the protrusion 604 by half-blanking after the protrusion 604 is formed by drawing, even if distortion is generated due to the material flow in the range by drawing that is performed earlier, since the formation of the stepped region 602 by half-blanking thereafter becomes bead processing, it is possible to correct distortion generated by drawing (press processing) by an effect of bead processing. Thus, it is possible to guarantee the flatness of the flat plate 110. Furthermore, since the protrusion 604 is formed before forming the stepped region 602, it is not necessary to provide the step 133 where the stepped region 602 enters in the dies 136 using for drawing forming the protrusion 604. In this regard, according to the second method, it is possible to simplify the press mold compared to the first method in which the step 133 where the stepped region 602 enters the dies 136 that is used in the drawing is necessary.

Third Method

Figure 15A:
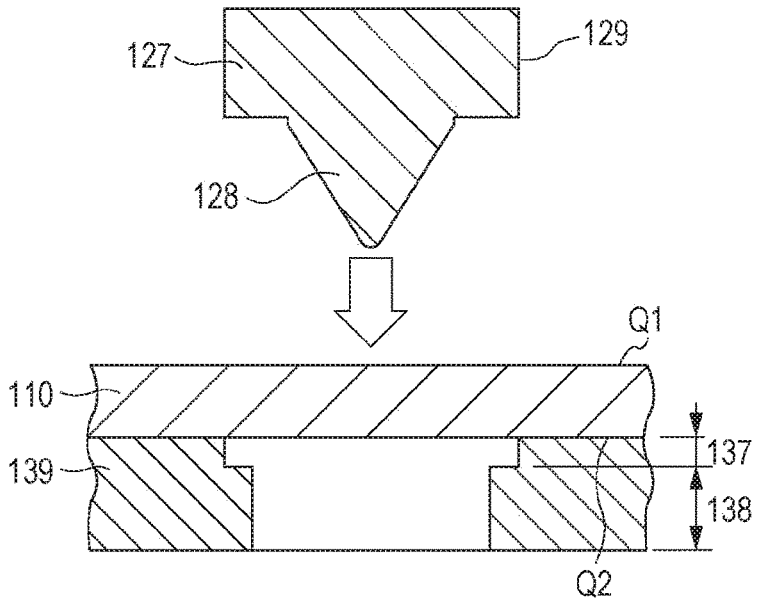
FIGS. 15A to 15C are views describing a third method of forming the protrusion within the stepped region in the fixing plate and processing views of a case where drawing for forming the protrusion and half-blanking for forming the stepped region are performed at the same time.
Figure 15B:
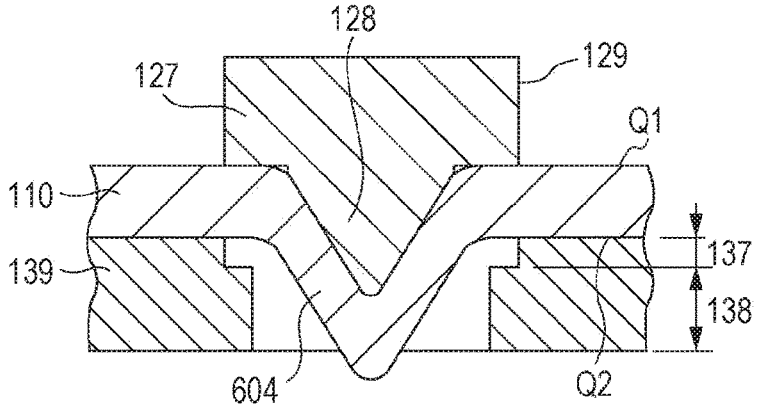
Figure 15C:
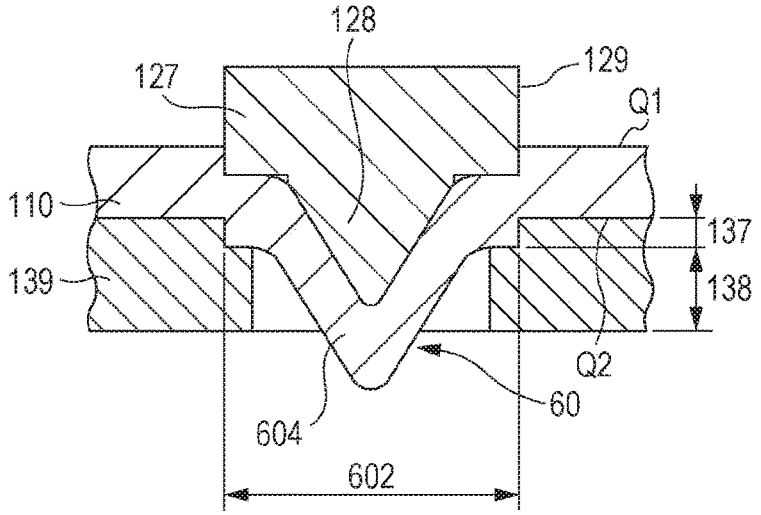

Next, a third method of simultaneously forming the protrusion 604 by drawing and the stepped region 602 by half-blanking will be described. FIGS. 15A to 15C are processing views describing the third method of forming the protrusion section 60 by the first embodiment.

The third method is performed by using a press mold configured of the punch 120 and the dies 130 that are molded to fit to the shapes of the protrusion 604 and the stepped region 602. The punch 120 used for the third method is configured, for example, by integrally forming a blade base section 127 for half-blanking for forming the stepped region 602 and a blade leading section 128 for drawing for forming the protrusion 604. The blade base section 127 for half-blanking is configured in the same shape as the punch 120 illustrated in FIGS. 11A to 11C and the blade leading section 128 for drawing is configured in the same shape as the punch 122 illustrated in FIGS. 12A to 12C. In accordance with this, the dies 139 is configured by integrally forming a blade hole section 137 for half-blanking for forming the stepped region 602 and a blade hole section 138 for drawing for forming the protrusion 604.

As illustrated in FIG. 15A, the dies 139 is disposed on one surface (second surface Q2) of the flat plate 110 and the punch 129 is disposed on the other surface (first surface Q1) of the flat plate 110. As illustrated in FIG. 15B, the flat plate 110 is pressed out and protrudes to the blade leading section 128 for drawing of the dies 139 by pressing the punch 124 and the protrusion 604 is formed. Thereafter, as illustrated in FIG. 15C, the flat plate 110 is pressed out to the blade base section 127 for half-blanking of the dies 136 by further pressing the punch 129 without being pulled out and then the stepped region 602 is formed so as to include the protrusion 604 that is formed earlier.

According to the third method of forming such a protrusion section 60, it is possible to form the protrusion 604 by drawing and the stepped region 602 by half-blanking in one process. Thus, it is possible to simultaneously form the stepped region 602 and the protrusion 604 within the stepped region 602 in the flat plate 110. Thus, even if drawing is performed, it is possible to guarantee the flatness of the flat plate 110. Furthermore, since the stepped region 602 and the protrusion 604 can be formed at one time without changing the punch 129 and the dies 139, positioning of the punch 129 and the dies 139 is also performed at one time. Thus, it is possible to save troubles of processing compared to the first method and the second method in which the stepped region 602 and the protrusion 604 are formed separately.

Second Embodiment

A second embodiment of the invention will be described below. Moreover, in each aspect illustrated below, the same reference numerals using in the description of the first embodiment are given to elements, of which effects and functions are the same as those of the first embodiment, and detailed description of each element will be omitted.

Figure 16A:
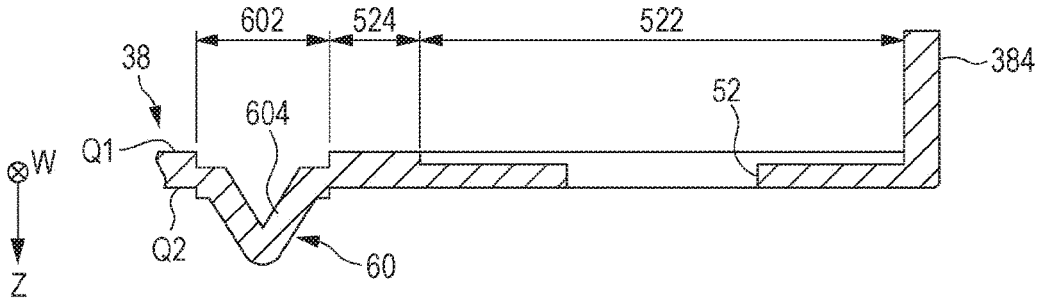
FIGS. 16A and 16B are explanatory views illustrating a relationship between a fixing plate and a liquid ejection section in a second embodiment.
Figure 16B:
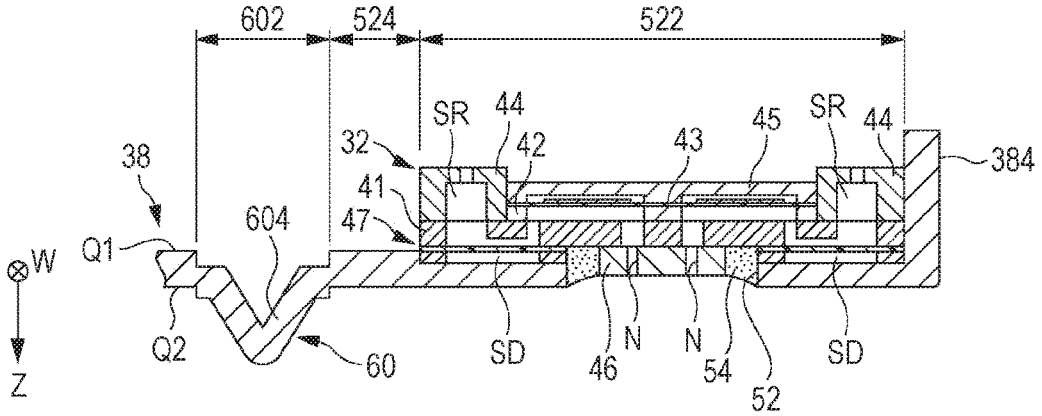

FIGS. 16A and 16B are explanatory views describing a relationship between a fixing plate 38 and a liquid ejection section 32 in the second embodiment and correspond to FIGS. 7A and 7B in the first embodiment. FIG. 16A is a sectional view that is taken along line XVIA-XVIA of the fixing plate 38 illustrated in FIG. 6 and FIG. 16B is a sectional view of a case where the liquid ejection section 32 is fixed to the fixing plate 38. Similar to drawing, punching for forming an opening section 52 in the flat plate is also a type of press processing and the opening section 52 is formed by disposing a dies on one surface of the flat plate and allowing a punch to press from the other surface. Thus, similar to a case of drawing, if the opening section 52 is formed in the flat plate only by punching, distortion or undulation is likely to occur when pressing the punch and there is a problem that flatness of the flat plate is lowered.

In order to suppress the distortion or undulation by press processing, in the first embodiment, the configuration, in which the stepped region 602 of which the height is different from that of the plane surface region of the flat plate (fixing plate 38) is formed and the protrusion 604 is formed within the stepped region 602 by drawing, is described. On the other hand, in the second embodiment, as illustrated in FIGS. 16A and 16B, a thick region 524 and a thin region 522 having thicknesses different from each other are formed in the flat plate configuring the fixing plate 38, and the opening section 52 is formed within the thin region 522 by press processing. Thus, since it is possible to thickening the thick region 524, it is possible to improve strength of the flat plate by the thick region 524. Therefore, since it is possible to suppress distortion due to press processing, it is possible to guarantee flatness of the flat plate (fixing plate 38) also in the second embodiment.

Specifically, the thin region 522 and the thick region 524 having the thicknesses different from each other are formed in the flat plate (fixing plate 38). The thin region 522 illustrated in FIG. 16A is formed such that a surface (first surface Q1) to which the liquid ejection section 32 of the fixing plate 38 is fixed is to be recessed. The thin region 522 is a stepped region of which a height is different from that of the thick region 524 when viewed from the first surface Q1. Thus, as illustrated in FIG. 16B, it is possible to fix the liquid ejection section 32 to the recessed portion within the thin region 522 such that a nozzle plate 46 exposes to the opening section 52 formed within the thin region 522. Therefore, it is possible to fix the liquid ejection section 32 on the liquid ejection surface by a recessed amount of the first surface Q1 within the thin region 522 compared to a case where the liquid ejection section 32 is fixed without forming the thin region 522. Thus, it is possible to narrow an interval between the nozzle plate 46 and the medium 12. Therefore, it is possible to increase prevention effect of a position shift of ejected liquid.

Figure 17A:
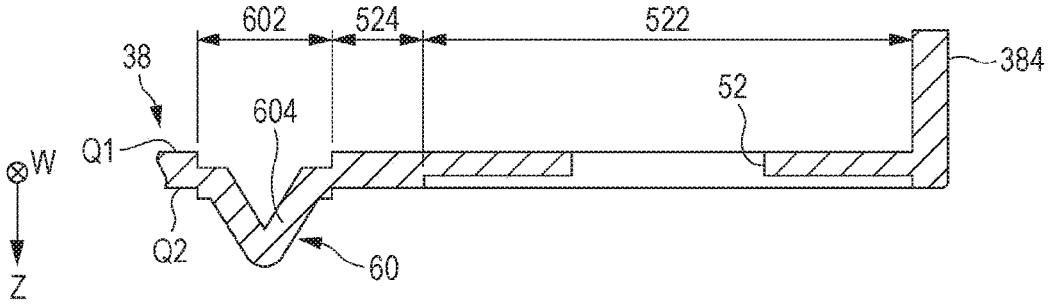
FIGS. 17A and 17B are explanatory views illustrating a relationship between a fixing plate and each liquid ejection section in a modification example of the second embodiment.
Figure 17B:
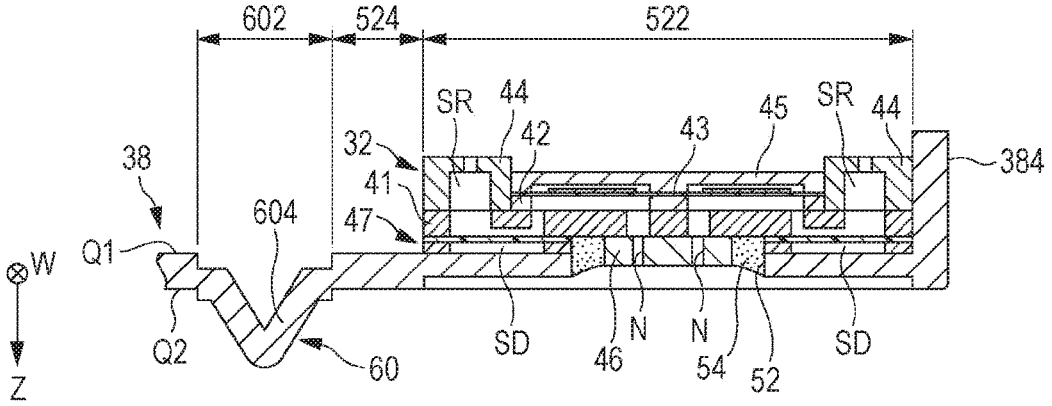

Moreover, the configuration of the thin region 522 is not limited to the example described above. As illustrated in FIG. 17A, the thin region 522 may be formed such that a surface (the second surface Q2) on a side opposite to the surface on which the liquid ejection section 32 of the fixing plate 38 is fixed is recessed. In this case, as illustrated in FIG. 17B, the liquid ejection section 32 is on the first surface Q1 side within the thin region 522 such that the nozzle plate 46 exposes to the opening section 52 formed within the thin region 522. Thus, it is possible to increase a distance between the nozzle plate 46 and the medium 12 by a recessed amount of the second surface Q2 within the thin region 522 compared to a case of FIG. 16B. Thus, as illustrated in FIG. 2, even if the medium 12 is deformed (for example, curled), it is difficult to come into contact with the nozzle plate 46 more than the case of FIG. 16B. However, as illustrated in FIG. 16B, if the thin region 522 is formed such that the first surface Q1 of the fixing plate 38 is recessed, the surface (second surface Q2) of the liquid ejection side of the fixing plate 38 is formed without being recessed. Thus, it is possible to reduce unevenness of the surface (second surface Q2) of the liquid ejection surface of the fixing plate 38 compared to FIG. 17B. Therefore, there is an advantage that the ink is unlikely to accumulate on the surface (second surface Q2) of the liquid ejection side.

The thin region 522 of the second embodiment is formed, for example, by press processing such as face pressing. However, a forming method of the thin region 522 is not limited to face pressing and the thin region 522 may be formed by etching and the like. After forming the thin region 522, the opening section 52 is formed within the thin region 522, for example, by punching. Moreover, the opening section 52 may be formed by removing a pressed-out portion after performing half-pressing. Moreover, details of a method of forming the opening section 52 within the thin region 522 will be described later in detail.

As will be understood from the description above, in the second embodiment, the thick region 524 and the thin region 522 having the thicknesses different from each other are formed in the flat plate configuring the fixing plate 38 and the opening section 52 is formed within the thin region 522 by press processing. Thus, it is possible to improve the strength of the flat plate by the thick region 524. Therefore, since it is possible to suppress distortion due to press processing, it is possible to easily maintain the flatness of the flat plate (fixing plate 38). Therefore, it is possible to manufacture the liquid ejecting head 30 in which the flatness of the fixing plate 38 is maintained. Furthermore, since the opening section 52 exposing the nozzle plate 46 is provided within the thin region 522, it is possible to allow a distance between the nozzle plate 46 and the medium 12 to be close. Moreover, in FIGS. 16A and 16B, and 17A and 17B, an example in which the protrusion section 60 is formed in the fixing plate 38 forming the thin region 522 of the embodiment is described, but the configuration is not limited to the embodiment, and the protrusion section 60 may not be formed.

Method of Forming Opening Section 52 for Disposing Nozzle Plate within Thin Region 522

Figure 18A:
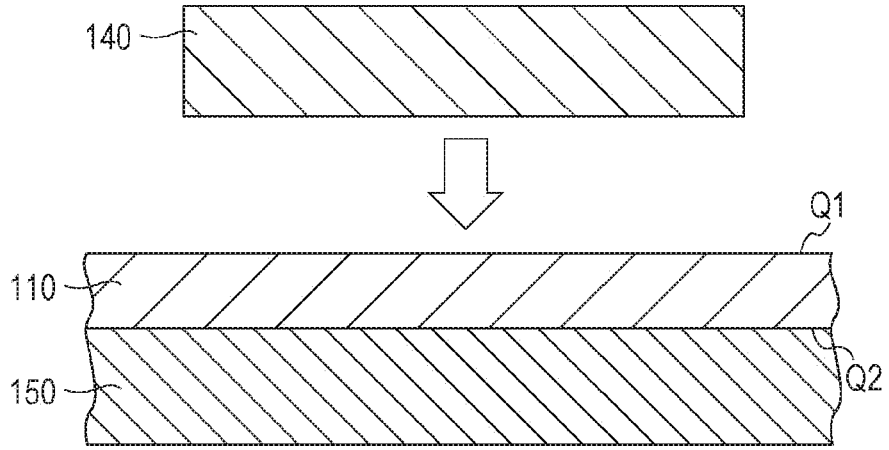
FIGS. 18A to 18C are views describing a method of forming an opening section within a thin region with respect to the fixing plate in the second embodiment and processing views of face pressing for forming the thin region that is performed earlier.
Figure 18B:
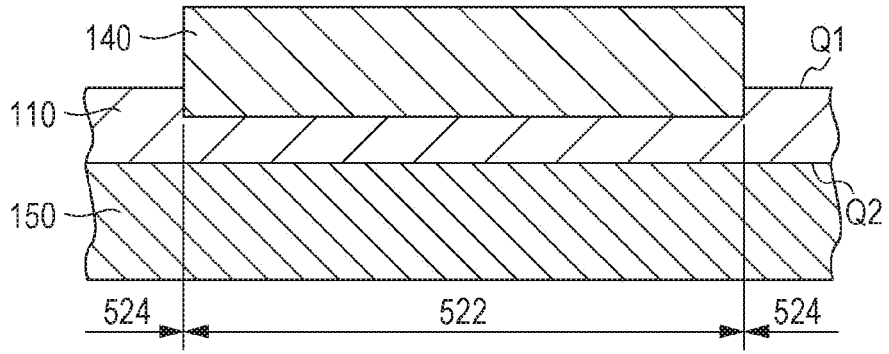
Figure 18C:
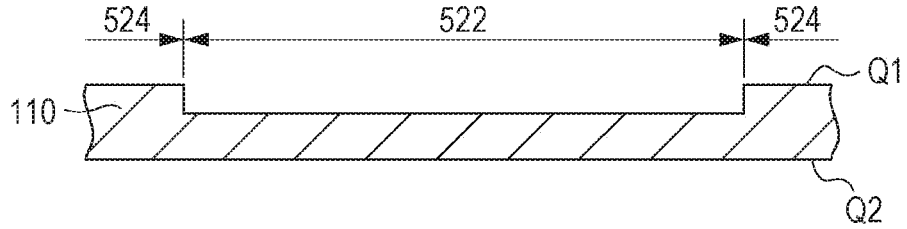
Figure 19A:
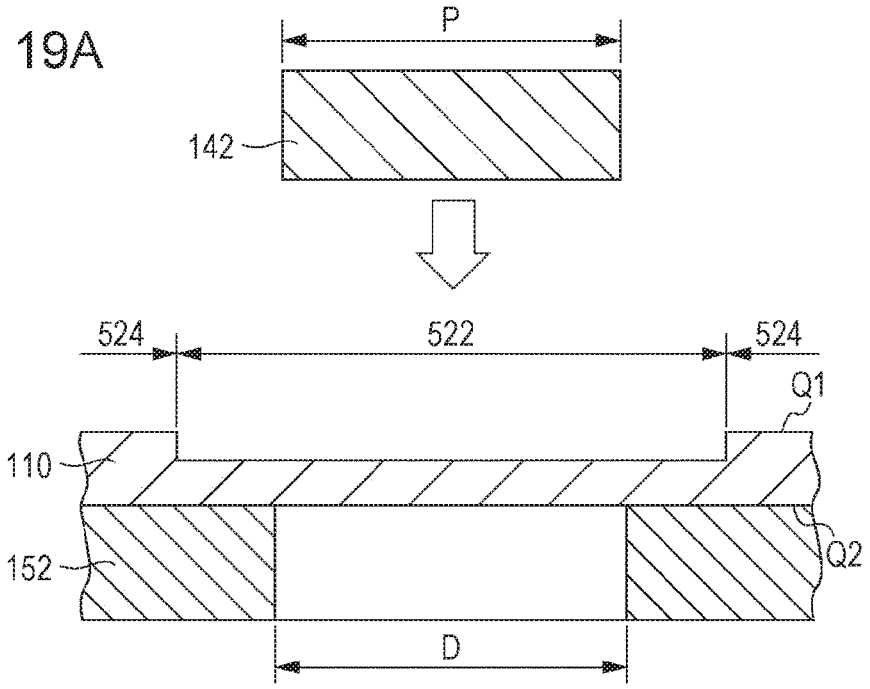
FIGS. 19A to 19C are processing views of punching for forming an opening section that is performed subsequent to face pressing of FIGS. 18A to 18C.
Figure 19B:
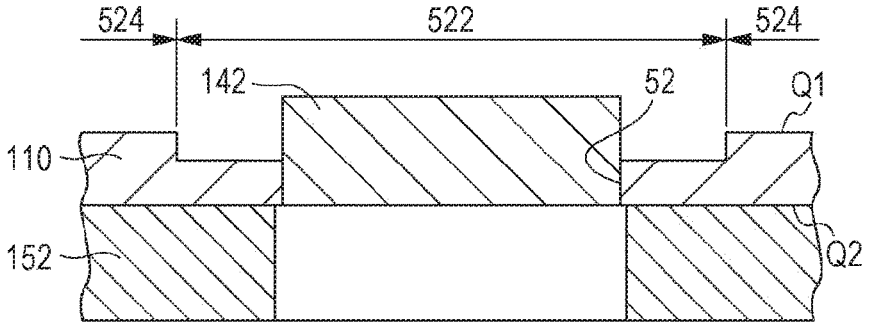
Figure 19C:
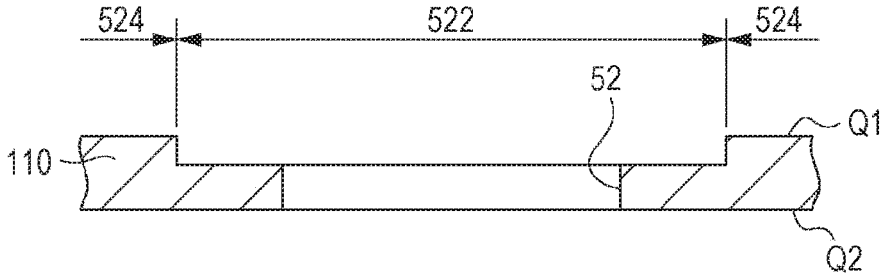

Here, when forming the fixing plate 38 by performing press processing in the flat plate, a method of forming the opening section 52 within the thin region 522 for disposing the nozzle plate 46 will be described in detail. Here, a case where the opening section 52 is formed by punching the flat plate 110 within the thin region 522 after the thin region 522 illustrated in FIG. 16A, which is recessed on the first surface Q1 side, is formed by face pressing is exemplified. FIGS. 18A to 18C and 19A to 19C are processing views describing a method of forming the opening section 52 for disposing the nozzle plate by the second embodiment. FIGS. 18A to 18C are processing views of face pressing that is performed earlier and FIGS. 19A to 19C are processing views of punching that is performed subsequently.

First, as illustrated in FIGS. 18A to 18C, the thin region 522 illustrated in FIG. 16A is formed by performing face pressing with respect to the flat plate 110. Face pressing is performed by using a press mold configured of a punch 140 and a dies 150 that are molded to fit to the shape of the thin region 522. Here, the punch 140 having a rectangular cross section, of which a leading end surface is a flat surface without changing a blade width from a base and to a leading end to fit to the shape of the thin region 522 illustrated in FIG. 16A, is used. The dies 150, of which a support surface supporting a portion forming the thin region 522 is flat, is used.

As illustrated in FIG. 18A, the dies 150 is disposed on one surface (second surface Q2) of the flat plate 110 and the punch 140 is disposed on the other surface (first surface Q1) of the flat plate 110. Then, as illustrated in FIG. 18B, the flat plate 110 is pressed by the dies 150 by pressing the punch 140 by a predetermined pressing amount and thereby the thin region 522 is formed. In this case, the predetermined pressing amount of the punch 140 is determined by a range in which a shear surface is formed in the inner surface 603 of the thin region 522. Thus, it is possible to form the thin region 522 while maintain the strength of the flat plate 110. After the punch 140 is pressed by the predetermined pressing amount, the punch 140 is pulled out from the flat plate 110. As described above, as illustrated in FIG. 18C, the thin region 522 having the thickness different from that of the thick region 524 is formed in the flat plate 110.

Moreover, if the thin region 522 illustrated in FIG. 17A, which is recessed on the second surface Q2 side is formed in the flat plate 110, installation positions of the punch 140 and the dies 150 may be reversed. Specifically, the dies 150 is disposed on the first surface Q1 of the flat plate 110, the punch 140 is disposed on the second surface Q2 of the flat plate 110, and pressing may be performed by pressing the punch 140.

Next, as illustrated in FIGS. 19A to 19C, the opening section 52 is formed by performing punching within the thin region 522 that is formed by half-blanking earlier. Punching is performed by using a press mold configured of a punch 142 and a dies 152 that are molded to fit to the shape of the opening section 52. Here, the punch 142 having a rectangular cross section, of which a leading end surface is a flat surface without changing a blade width from a base end to a leading end, is used to be fitted into the shape of the opening section 52 illustrated in FIG. 16A. Here, the dies 152 including a blade hole having a rectangular cross section to fit to a blade shape of the punch 142 is used. For a clearance between a blade width P of the punch 142 and a blade width D of the dies 152 in punching, it is preferable that the blade width P of the punch 142 is slightly less than the blade width D of the dies 152.

As illustrated in FIG. 19A, the dies 152 is disposed on one surface (second surface Q2) of the flat plate 110 and the punch 142 is disposed on the other surface (first surface Q1) of the flat plate 110. As illustrated in FIG. 19B, the opening section 52 is formed in the flat plate 110 by punching the flat plate 110 by the punch 142. If the punch 142 is pulled out from the flat plate 110, as illustrated in FIG. 19C, the opening section 52 is formed within the thin region 522 and then the opening section 52 by the embodiment is formed in the flat plate 110. It is possible to form a plurality of opening sections 52 in the flat plate 110 by performing the processes of FIGS. 18A to 18C and 19A to 19C in the plurality of opening sections 52. Moreover, if the plurality of opening sections 52 are formed in the same flat plate 110, after a plurality of thin regions 522 are formed earlier by repeating the processes of FIGS. 18A to 18C, the opening sections 52 may be formed in each thin region 522 by repeating the processes of FIGS. 19A to 19C.

According to the methods described above, the thick region 524 and the thin region 522 having the thicknesses different from each other are formed in the flat plate 110, and the opening section 52 exposing the nozzle plate 46 is formed within the thin region 522. Thus, since it is possible to form the thin region 522 in the thick region 524 having a thicker thickness, it is possible to improve the durability (strength) of the flat plate. Thus, since it is possible to suppress distortion due to press processing, it is possible to easily maintain the flatness of the flat plate (fixing plate 38). Moreover, since the opening section 52 is formed within the thin region 522 by punching after forming the thin region 522 by face pressing, the distortion is suppressed or corrected by punching (press processing). Thus, it is also possible to guarantee the flatness of the flat plate.

Furthermore, in the second embodiment, as the method of forming the opening section 52 within the thin region 522, the method of forming the opening section 52 within the thin region 522 by punching after forming the thin region 522 in the flat plate 110 is exemplified, but the method is not limited to the embodiment. For example, the thin region 522 may be formed by face pressing after the opening section 52 is formed in the flat plate 110 by punching. In addition, the thin region 522 and the opening section 52 may be simultaneously formed in the flat plate 110.

Third Embodiment

Figure 20A:
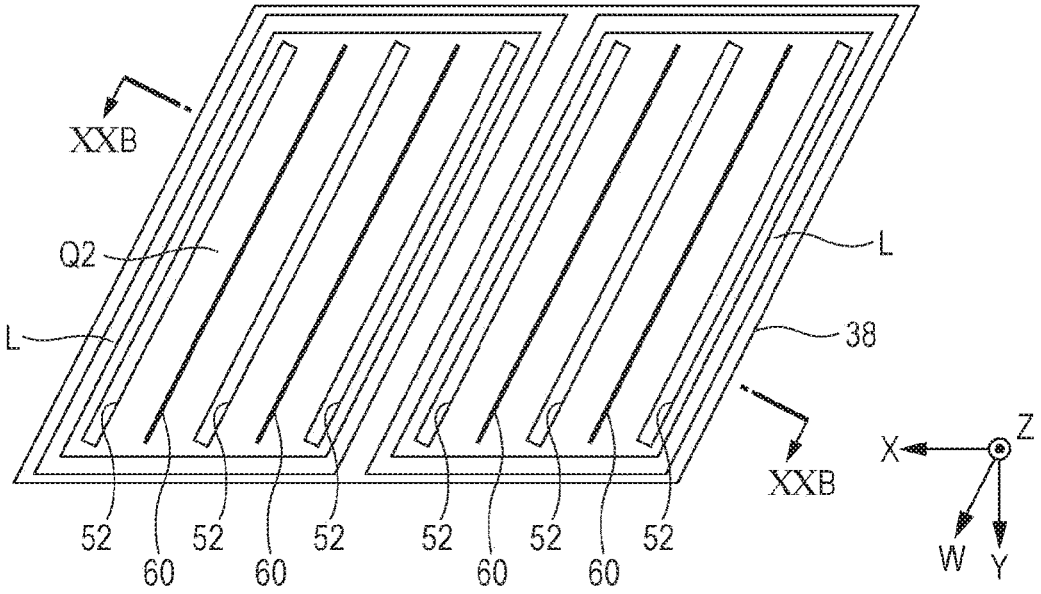
FIG. 20A is a plan view of a second surface of a fixing plate in a third embodiment and FIG. 20B is a sectional view of a second surface of a fixing plate in a third embodiment.
Figure 20B:
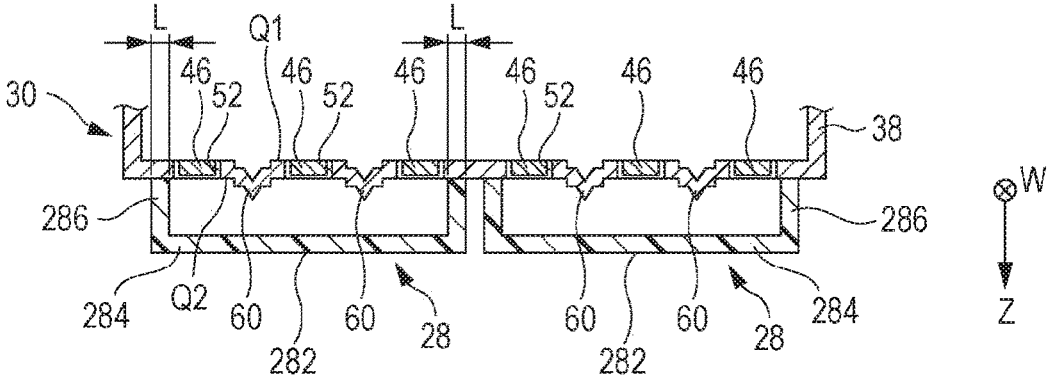

A third embodiment of the invention will be described below. FIGS. 20A and 20B are views illustrating a configuration example of a liquid ejecting head 30 according to the third embodiment. Here, as another configuration example of the liquid ejecting head 30 capable of applying a forming method of the protrusion section 60 by the first embodiment described above, a specific example of a case where the protrusion section 60 is formed in consideration of a region allowing a sealing mechanism (cap) 28 to abut a fixing plate 38 for preventing drying of nozzles N and the like is exemplified.

In FIG. 20A, a plan view of a second surface Q2 of the fixing plate 38 and a cross section view of line XXB-XXB are described together. As will be understood from the sectional view of FIG. 20B, the sealing mechanism 28 includes a plurality of sealing bodies 282 which seal each nozzle N by coming into contact with the second surface Q2 (liquid ejection surface) of the fixing plate 38 when performing a maintenance operation such as cleaning of a plurality of nozzles N. In the sealing mechanism (cap) 28 of FIG. 20B, a case where two sealing bodies 282 are used with respect to one liquid ejecting head 30 is provided as an example. Each sealing body 282 is an elastic body in which a base section 284 and a sealing section 286 are integrally formed, and is formed, for example, by injection molding of a resin material.

The base section 284 is a flat plate-shaped portion and the sealing section 286 is a circular (specifically, rectangular frame shape) portion protruding from a periphery of the base section 284. A top surface of the sealing section 286 on a side opposite to the base section 284 abuts the second surface Q2 of the fixing plate 38 and then each nozzle N is sealed. As illustrated in FIG. 20B, the plurality of protrusion sections 60 of the fixing plate 38 are formed in a region other than a circular region (hereinafter, referred to as "sealing region") L coming into contact with the sealing bodies 282 in the second surface Q2 and do not overlap the sealing region L when viewed in a plan view. Specifically, the plurality of protrusion sections 60 are formed in a region (region surrounded by the sealing region L) on an inside of an inner periphery of the sealing region L when viewed in a plan view in the second surface Q2. As described above, in the first embodiment, there is an advantage that each nozzle N can be sufficiently sealed by allowing the sealing body 282 (sealing section 286) to come into contact with the second surface Q2 compared to a configuration in which the protrusion section 60 is formed within the sealing region L because the protrusion section 60 is not formed in the sealing region L in the second surface Q2 of the fixing plate 38.

Similar to the first embodiment, since the protrusion section 60 illustrated in FIGS. 20A and 20B is configured by forming a protrusion 604 within a stepped region 602 by drawing, distortion due to drawing (press processing) is suppressed or corrected. Thus, it is possible to guarantee flatness of the flat plate after press processing. Thus, also in the liquid ejecting head 30 having the configuration illustrated in FIGS. 20A and 20B, it is possible to manufacture the liquid ejecting head 30 where the flatness of the fixing plate 38 is maintained. Furthermore, also for the opening section 52 illustrated in FIGS. 20A and 20B, similar to the second embodiment, a thick region 524 and the thin region 522 having thicknesses different from each other are formed, and the opening section 52 may be formed within the thin region 522 by punching. Thus, it is possible to improve strength of the flat plate by the thick region 524. Therefore, distortion due to press processing is suppressed and it is possible to easily maintain the flatness of the flat plate.

Fourth Embodiment

A fourth embodiment of the invention will be described below. Here, as another configuration example of the liquid ejecting head 30 capable of applying a forming method of the protrusion section 60 by the first embodiment described above, a specific example of a case where the configuration of the protrusion section 60 is changed is exemplified.

Figure 21:
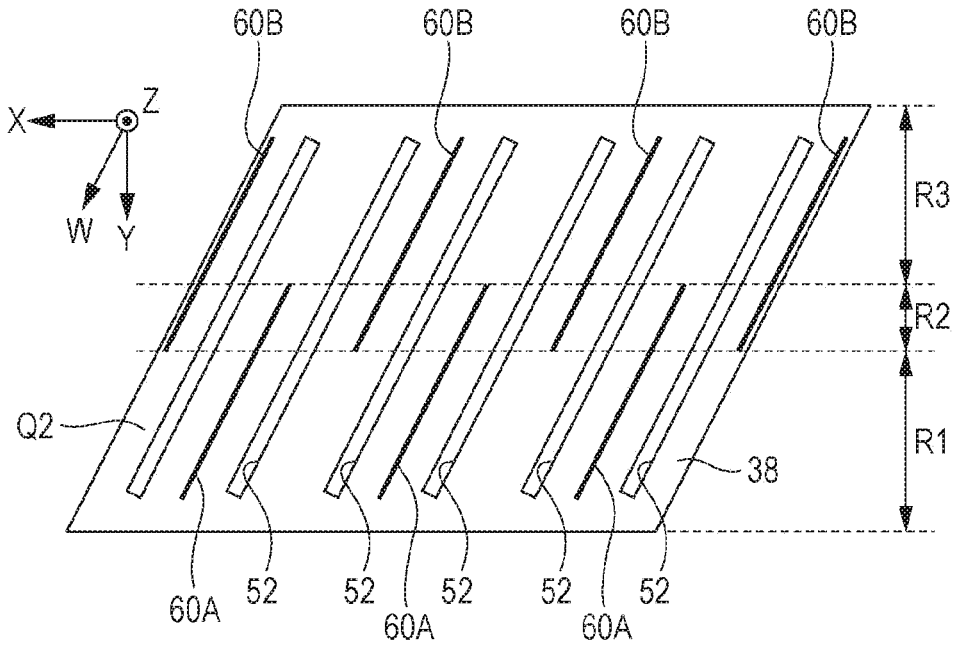
FIG. 21 is a plan view of a second surface of a fixing plate in a fourth embodiment.

FIG. 21 is a configuration example of the liquid ejecting head 30 according to the fourth embodiment and is a plan view of a second surface Q2 of a fixing plate 38. As illustrated in FIG. 21, a plurality of protrusion sections 60 formed in the fixing plate 38 of the fourth embodiment include a plurality of first protrusion sections 60A and a plurality of second protrusion sections 60B. The plurality of first protrusion sections 60A are arranged in an X-direction at intervals each other and respectively extend in a W-direction. similarly, the plurality of second protrusion sections 60B are arranged in an X-direction at intervals each other and respectively extend in a W-direction. The first protrusion section 60A and the second protrusion sections 60B are alternately arranged in the X-direction.

As illustrated in FIG. 21, a second surface Q2 (nozzle distribution region R) of the fixing plate 38 of the fourth embodiment is appropriately divided into a first region R1, a second region R2, and a third region R3 in a Y-direction. The first region R1 is positioned on a positive side in the Y-direction when viewed from the second region R2 and the third region R3 is positioned on a negative side in the Y-direction when viewed from the second region R2. The first protrusion section 60A extends through the first region R1 and the second region R2 in the W-direction, and is not formed in the third region R3. On the other hand, the second protrusion section 60B extends through the second region R2 and the third region R3 in the W-direction, and is not formed in the first region R1. As will be understood from the description above, in the fourth embodiment, positions of the first protrusion section 60A and the second protrusion section 60B are different from each other in the Y-direction in which the medium 12 is transported, and partially (that is, limited in the second region R2) overlap each other in the Y-direction.

Similar to the first embodiment, in the fourth embodiment, each protrusion section 60 (the first protrusion section 60A and the second protrusion section 60B) is configured such that a protrusion 604 formed by drawing is disposed within a stepped region 602. In FIG. 21, for the sake of convenience, the stepped region 602 and the protrusion 604 are represented as straight lines as the protrusion sections 60 (the first protrusion sections 60A and the second protrusion sections 60B).

Also in the fourth embodiment, the same effects as the first embodiment are realized. Furthermore, in the fourth embodiment, since the protrusion section 60 is shortened compared to the configuration in which the protrusion section 60 extends over an entire region of the second surface Q2 in the W-direction, there is an advantage that it is possible to suppress deformation (particularly, deformation of a case where the protrusion section 60 is formed by drawing) of the fixing plate 38 due to the formation of the protrusion section 60. Moreover, in a configuration (for example, configuration in which both the first protrusion section 60A and the second protrusion section 60B are not formed in the second region R2) in which the first protrusion section 60A and the second protrusion section 60B do not overlap in the Y-direction, since the medium 12 comes into contact with the second surface Q2 of the fixing plate 38 in the second region R2 of FIG. 21, ink remaining on an inside of the opening section 52 may attach to the medium 12. In the fourth embodiment, since the first protrusion section 60A and the second protrusion section 60B partially overlap each other in the Y-direction, there is an advantage that it is possible to effectively prevent the medium 12 from coming into contact with the second surface Q2 regardless of a configuration in which a length of each protrusion section 60 is shortened.

Fifth Embodiment

A fifth embodiment of the invention will be described below. In the first to fourth embodiments described above, for the liquid ejecting head in which the fixing plate 38 fixing the plurality of nozzle plates 46 is provided, a case where the fixing plate 38 is exemplified as the flat plate defining the liquid ejection surface and the protrusion sections 60 formed by drawing are formed in the fixing plate 38 is described. In the fifth embodiment, for a liquid ejecting head in which a fixing plate 38 is not provided, a case where a nozzle plate 72 is exemplified as a flat plate defining the liquid ejection surface and protrusion sections 60 formed by drawing are formed in the nozzle plate 72 will be described.

Figure 22:
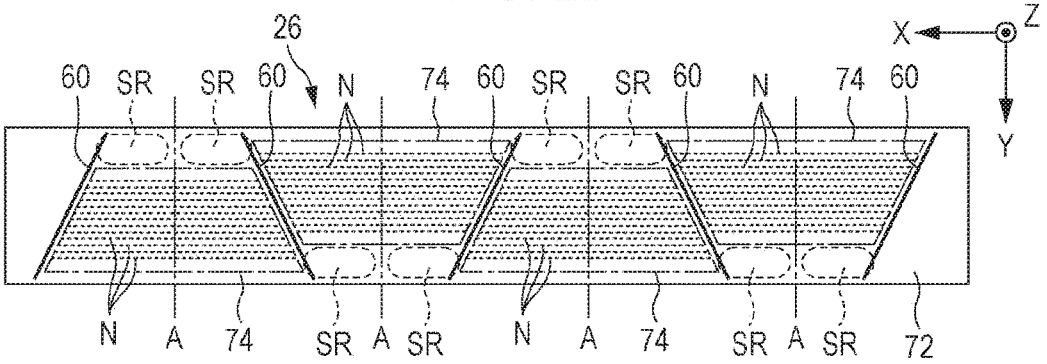
FIG. 22 is a plan view of an ejection surface of a liquid ejecting unit in a fifth embodiment and a view describing a specific example of a case where a protrusion section is formed in a nozzle plate.

FIG. 22 is a plan view of the liquid ejection surface facing the medium 12 in a liquid ejecting unit 26 of the fifth embodiment. As illustrated in FIG. 22, the liquid ejecting unit 26 of the fifth embodiment is a long line head in an X-direction including a nozzle plate 72 facing the medium 12. The nozzle plate 72 is a long flat plate in the X-direction over an entire width of the medium 12.

As illustrated in FIG. 22, a plurality of nozzle distribution regions 74 arranged in the X-direction are defined in the nozzle plate 72. Each nozzle distribution region 74 is a region of a trapezoidal shape (specifically, isosceles trapezoid) when viewed in a plan view. The plurality of nozzle distribution regions 74 are defined such that a positional relationship between an upper base and a lower base is inverted between the nozzle distribution regions 74 adjacent to each other in the X-direction. A plurality of nozzles N are formed in each nozzle distribution region 74 in the X-direction and the Y-direction. As will be understood from the description above, a surface (surface facing the medium 12) positioned on a positive side in the Z-direction in the nozzle plate 72 functions as a liquid ejection surface in which the plurality of nozzles N are disposed.

As illustrated in FIG. 22, the plurality of protrusion sections 60 are formed on the liquid ejection surface of the nozzle plate 72 of the fifth embodiment. Each protrusion section 60 protrudes from the liquid ejection surface formed in a direction (second direction) intersecting the X-direction. Specifically, the linear protrusion section 60 is formed within an interval of the nozzle distribution regions 74 adjacent to each other in the X-direction along a direction of respective legs of the trapezoid. That is, each protrusion section 60 of the fifth embodiment extends in a direction that is inclined in the X-direction. As illustrated in FIGS. 17A and 17B, the protrusion sections 60 which are respectively adjacent to each other in the X-direction are in a relationship of a line symmetry with respect to an axis A orthogonal to the X-direction.

As illustrated in FIG. 22, the liquid ejecting unit 26 of the fifth embodiment includes a plurality of storage chambers SR. Similar to the first embodiment, each storage chamber SR is a space storing ink ejected from the plurality of nozzles N. specifically, the storage chamber SR is formed in a position corresponding to a top point of each nozzle distribution regions 74 when viewed in a plan view (viewed from a direction perpendicular to the liquid ejection surface). The ink distributed in a plurality of flow paths from the storage chamber SR is ejected from each nozzle N. As will be understood from FIG. 22, each protrusion section 60 of the fifth embodiment is provided in a position that overlaps the storage chamber SR when viewed in a plan view. On the other hand, each nozzle N is formed in a position that does not overlap the storage chamber SR when viewed in a plan view. As described above, in the fifth embodiment, the region (originally, the region in which the nozzles N are not formed) that overlaps the storage chamber SR in the liquid ejection surface when viewed in a plan view is effectively used for forming the protrusion section 60. Thus, it is possible to dispose the plurality of nozzles N with high density compared to a configuration in which the protrusion section 60 is formed so as not to overlap the storage chamber SR.

A shape of each protrusion section 60 of the fifth embodiment is similar to that of each embodiment described above. In the fifth embodiment, similar to the first embodiment, each protrusion section 60 provided in the nozzle plate 72 is configured by disposing the protrusion 604 by drawing within the stepped region 602. Moreover, in FIG. 22, for the sake of convenience, the stepped region 602 and the protrusion 604 are represented as straight lines as the protrusion section 60.

In the fifth embodiment described above, similar to the first embodiment, each protrusion section 60 provided in the nozzle plate 72 is configured by disposing the protrusion 604 by drawing within the stepped region 602. Thus, it is possible to obtain the same effects as the first embodiment. In addition, the protrusion section 60 is formed in the flat plate configuring the nozzle plate 72 and then the opening of the nozzle N is formed as another example of the through-hole. Thus, it is possible that the opening of the nozzle N is not affected by influence of distortion by drawing. In addition, the protrusion section 60 protruding from the liquid ejection surface in which the plurality of nozzles N are arranged is disposed in a direction intersecting (orthogonal or inclined) in the X-direction that is a longitudinal direction of the line head. Thus, there is an advantage that it is possible to prevent the medium 12 from coming into contact with the liquid ejection surface over a wide range in the Y-direction in which the medium 12 is transported compared to a configuration in which the protrusion section 60 is formed in the X-direction.

Figure 23:
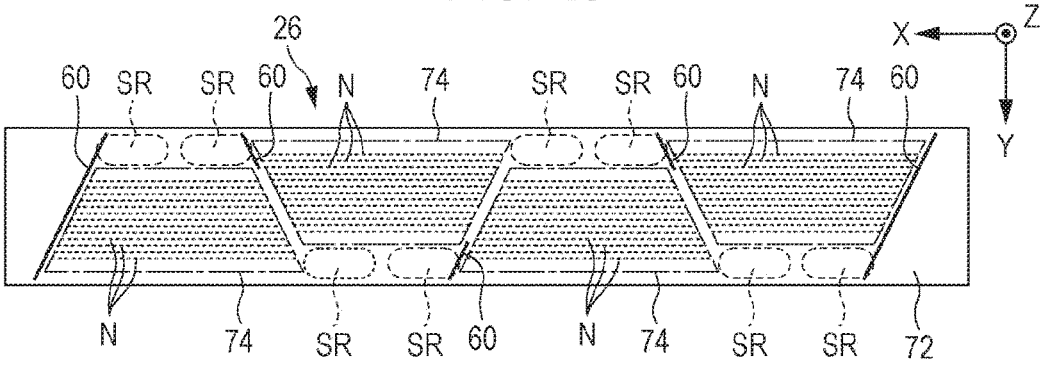
FIG. 23 is a plan view of an ejection surface in a modification example of the fifth embodiment.

Moreover, in FIG. 22, the configuration, in which the protrusion section 60 extends over an entire length of the interval of the nozzle distribution regions 74 adjacent to each other in the X-direction, is exemplified, but for example, as illustrated in FIG. 23, the protrusion section 60 may be formed in only a part of the interval of the nozzle distribution regions 74. In the configuration of FIG. 23, there is no need to ensure a space for forming the protrusion section 60 in the interval of the nozzle distribution regions 74. Thus, there is an advantage that it is possible to dispose the plurality of nozzles N with high density by disposing each nozzle distribution region 74 close to each other.

Sixth Embodiment

A sixth embodiment of the invention will be described below. Here, for a liquid ejecting head without a fixing plate 38, another specific example in which a nozzle plate 72 is a flat plate defining a liquid ejection surface and a protrusion section 60 is formed in the nozzle plate 72 is described.

Figure 24:
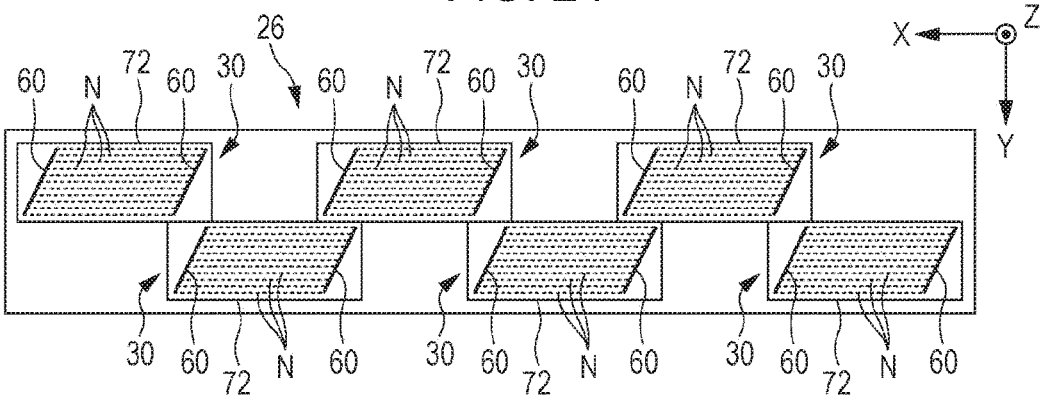
FIG. 24 is a plan view of an ejection surface of a liquid ejecting unit in a sixth embodiment.

FIG. 24 is a plan view of the liquid ejection surface facing a medium 12 in a liquid ejecting unit 26 of the sixth embodiment. As illustrated in FIG. 24, the liquid ejecting unit 26 of the sixth embodiment includes a plurality of liquid ejecting heads 30 which are arranged zigzag (so-called staggered arrangement) in an X-direction. Each of the plurality of liquid ejecting heads 30 includes a nozzle plate 72 where the plurality of nozzles N are formed within an X-Y plane. A plurality of protrusion sections 60 are formed in the liquid ejection surface facing the medium 12 in the nozzle plate 72 of each liquid ejecting heads 30. Each protrusion section 60 protrudes from the liquid ejection surface formed in a direction intersecting (orthogonal or inclined) the X-direction.

A shape of each protrusion section 60 of the sixth embodiment is similar to that of each embodiment described above. In the sixth embodiment, similar to the first embodiment, each protrusion section 60 provided in the nozzle plate 72 is configured by disposing the protrusion 604 formed by drawing within the stepped region 602. In addition, the protrusion section 60 is formed in a flat plate configuring the nozzle plate 72. Thus, it is possible that the opening of the nozzle N is not affected by influence of distortion by drawing by forming the opening of the nozzle N as another example of the through-hole. Moreover, in FIG. 24, for the sake of convenience, the stepped region 602 and the protrusion 604 are represented as straight lines as the protrusion section 60. Thus, also in the sixth embodiment, the same effects as each embodiment described above are realized.

The first to sixth embodiments described above are generically represented as a configuration in which the protrusion section 60 protruding from the liquid ejection surface in which the plurality of nozzles N are disposed is disposed, and functions and applications of members forming the liquid ejection surface are unquestioned. Regardless of whether the liquid ejection surface is formed in the fixing plate 38 as the first to fourth embodiments, or the liquid ejection surface is formed in the nozzle plate 72 as the fifth embodiment or the sixth embodiment, various configurations (for example, the shape of the protrusion section 60 and the like) illustrated in each aspect described above are similarly applied.

Modification Examples

The aspects described above can be variously modified. Specific modification aspects are exemplified below. Two or more aspects arbitrarily selected from the following examples may be merged appropriately within a range not mutually inconsistent.

Figure 25A:
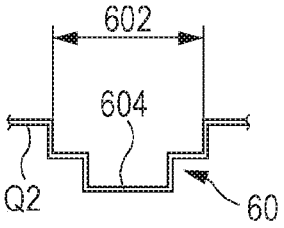
FIGS. 25A to 25D are views describing a cross sectional shape of a protrusion section as a modification example of the protrusion section in the first to sixth embodiments.
Figure 25B:
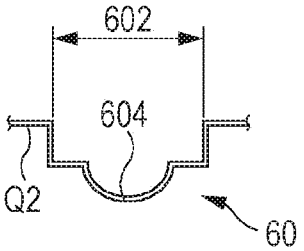
Figure 25C:
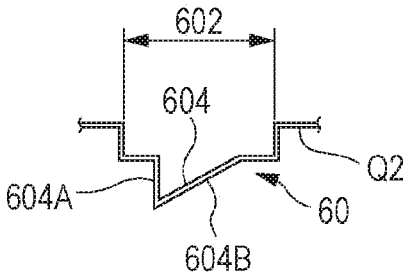

(1) The cross section shape (shape of the surface of the protrusion 604 within the cross section perpendicular in the W-direction) of the protrusion 604 of the protrusion section 60 is not limited to the example of each aspect described above. For example, the protrusion section 60 may be formed by protrusions 604 having cross sections illustrated in FIGS. 25A to 25D. In the protrusion 604 of FIG. 25A, a cross section shape is a rectangular shape (rectangular) and in the protrusion 604 of FIG. 25B, the cross section shape is an arcuate shape. The protrusion 604 of FIG. 25A may be formed by half-blanking similar to the stepped region 602. Moreover, the cross section shape of the protrusion 604 is not limited to the line-symmetrical shape. For example, as illustrated in FIG. 25C, the protrusion section 60 may be formed by a protrusion 604 of a triangular cross section configured of a side surface 604A perpendicular to a liquid ejection surface (second surface Q2) and a side surface 604B inclined to the liquid ejection surface. As the embodiments described above, FIGS. 25B, and 25C, in the configuration in which the protrusion 604 of the protrusion section 60 includes the inclined surface with respect to the liquid ejection surface, there is an advantage that the ink adhered to the liquid ejection surface can be effectively wiped by a wiper, for example, compared to the configuration of FIG. 25A.

Figure 25D:
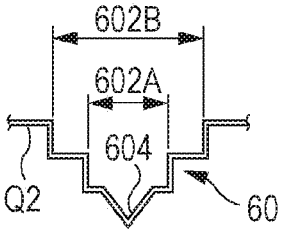

In addition, the cross section shape (shape of the surface of the stepped region 602 within the cross section perpendicular in the W-direction) of the stepped region 602 of the protrusion section 60 is not limited to each aspect described above. For example, as illustrated in FIG. 25D, a plurality (two steps in FIG. 25D) of steps of the stepped region 602 having different widths may be formed by overlapping each other. In this case, a stepped region 602A having a small width is disposed on the liquid ejection side on the second surface Q2 and is formed such that the stepped region 602A having the small width is included within a stepped region 602B having a large width. In this case, the protrusion 604 may be formed by drawing after performing half-blanking of the stepped region 602A and the stepped region 602B or half-blanking of the stepped region 602A and the stepped region 602B may be performed after the protrusion 604 is formed by drawing. In addition, the stepped region 602 is not limited to the two steps and may be formed in three steps or more. As described above, the flatness of the flat plate is further easily maintained by making the stepped region 602 be multiple steps by performing half-blanking a plurality of times. In addition, a planar shape (outer shape of the protrusion section 60 when viewed in the Z-direction) of the protrusion 604 of the protrusion section 60 is not limited to each aspect described above. For example, the planar shape may be formed in an arcuate shape (crescent).

(2) In the first to fourth embodiments, in each liquid ejection section 32, the support plate 474 of the compliance section 47 is fixed to the first surface Q1 of the fixing plate 38, but a member that is bonded to the fixing plate 38 in the liquid ejection section 32 is not limited to the support plate 474. For example, in a configuration in which the compliance section 47 is disposed in a portion other than a surface facing the fixing plate 38 in the liquid ejection section 32, or a configuration in which the compliance section 47 is omitted, a surface of the flow path substrate 41 on the positive side in the Z-direction may be fixed to the first surface Q1 of the fixing plate 38, for example, by adhesive.

(3) The type of ejecting the ink by the liquid ejection section 32 is not limited to the type described above (piezo type) using the piezoelectric element. For example, the invention can be also applied to a liquid ejecting head of a type (thermal type) using a heat generating element for varying a pressure within a pressure chamber by generating air bubbles within the pressure chamber by heating.

(4) The printing apparatus 10 illustrated in each aspect described above may be employed in various apparatuses such as a facsimile apparatus and a copying machine. However, application of the liquid ejecting apparatus of the invention is not limited to printing. For example, a liquid ejecting apparatus ejecting a solution of a color material is used as a manufacturing apparatus for forming a color filter of a liquid crystal display apparatus. In addition, a liquid ejecting apparatus ejecting a conductive material is used as a manufacturing apparatus for forming a wire or an electrode of a wiring substrate.

What is claimed is:

1. A liquid ejecting head comprising:

a liquid ejection section that has a nozzle plate in which nozzles ejecting liquid are provided; and a flat plate that fixes a plurality of liquid ejection sections, wherein the flat plate has a thickness in a direction from a liquid ejecting side of the flat plate to a side opposite to the liquid ejecting side, and includes a thick region and a thin region of which thicknesses are different from each other, and a through-hole that is provided within the thin region, and wherein the nozzle plate is exposed on the liquid ejection side of the flat plate by the through-hole.

2. The liquid ejecting head according to claim 1, wherein the thin region is formed such that a surface of the flat plate on a side opposite to the liquid ejection side is recessed, and wherein the liquid ejection section is fixed within the recessed region.

3. The liquid ejecting head according to claim 1, wherein the thin region is formed such that a surface of the flat plate on the liquid ejection side is recessed, and the liquid ejection section is fixed to a surface on a side opposite to the recessed region.

4. The liquid ejecting head according to claim 1, wherein the thick region includes a stepped region and a protrusion, the protrusion protruding to the liquid ejection side.

5. The liquid ejecting head according to claim 4, wherein the stepped region protrudes to the liquid ejection side.

6. The liquid ejecting head according to claim 5, wherein a protrusion amount of the protrusion from the stepped region is greater than a stepped amount of the stepped region from the thick region.

7. The liquid ejecting head according to claim 6, wherein the protrusion amount of the protrusion is greater than a thickness of the stepped region of the flat plate.

8. The liquid ejecting head according to claim 4, wherein a protrusion amount of the protrusion from the stepped region is greater than a stepped amount of the stepped region from the thick region.

9. The liquid ejecting head according to claim 4, wherein the protrusion amount of the protrusion is greater than a thickness of the stepped region of the flat plate.

10. A liquid ejecting head comprising:

a liquid ejection section that has a nozzle plate in which nozzles ejecting liquid are provided; and a flat plate that fixes a plurality of liquid ejection sections, wherein the flat plate has a thick region and a thin region of which thicknesses are different from each other, and a through-hole that is provided within the thin region, wherein the nozzle plate is exposed on a liquid ejection side of the flat plate by the through-hole, and wherein the thick region includes a stepped region and a protrusion, the protrusion protruding to the liquid ejection side.

11. The liquid ejecting head according to claim 10, wherein the stepped region protrudes to the liquid ejection side.

12. The liquid ejecting head according to claim 11, wherein a protrusion amount of the protrusion from the stepped region is greater than a stepped amount of the stepped region from the thick region.

13. The liquid ejecting head according to claim 12, wherein the protrusion amount of the protrusion is greater than a thickness of the stepped region of the flat plate.

14. The liquid ejecting head according to claim 10, wherein a protrusion amount of the protrusion from the stepped region is greater than a stepped amount of the stepped region from the thick region.

15. The liquid ejecting head according to claim 10, wherein the protrusion amount of the protrusion is greater than a thickness of the stepped region of the flat plate.

* * * * *